US012781308B2

(12) United States Patent
Lindberg et al.

(10) Patent No.: US 12,781,308 B2
(45) Date of Patent: Nov. 3, 2026

(54) GEOTHERMALLY POWERED PYROMETALLURGICAL COPPER PRODUCTION

(71) Applicant: EnhancedGEO Holdings, LLC, St. Petersburg, FL (US)

(72) Inventors: Greg Lindberg, Thonotosassa, FL (US); Kimberly C. Conner, Wetumpka, AL (US)

(73) Assignee: Enhanced Geo Holdings, LLC, Thonotosassa, FL (US)

( * ) Notice: Subject to any disclaimer, the term of this patent is extended or adjusted under 35 U.S.C. 154(b) by 584 days.

(21) Appl. No.: 18/236,469

(22) Filed: Aug. 22, 2023

(65) Prior Publication Data

US 2025/0066873 A1 Feb. 27, 2025

(51) Int. Cl.

| | |
|---|---|
| ***C25C 3/00*** | (2006.01) |
| ***C22B 3/04*** | (2006.01) |
| ***C22B 3/20*** | (2006.01) |
| ***C22B 15/00*** | (2006.01) |

(Continued)

(52) U.S. Cl.

CPC ..... *C22B 15/0041* (2013.01); *C22B 3/04* (2013.01); *C22B 3/20* (2013.01); *C22B 15/0004* (2013.01); *C22B 15/0052* (2013.01); *C22B 15/0065* (2013.01); *C25C 3/34* (2013.01)

(58) Field of Classification Search

CPC ..... C25B 15/0041; C25B 3/04; C25B 3/20; C25B 15/0004; C25B 15/0052; C25B 15/0065; C25C 3/34

See application file for complete search history.

(56) References Cited

U.S. PATENT DOCUMENTS

| | | | |
|---|---|---|---|
| 3,498,381 | A | 3/1970 | Earlougher, Jr. |
| 3,757,516 | A | 9/1973 | Mc |

(Continued)

FOREIGN PATENT DOCUMENTS

| | | | |
|---|---|---|---|
| EP | 0236640 | A1 | 9/1987 |
| JP | H07286760 | A | 10/1995 |

(Continued)

OTHER PUBLICATIONS

Boehm, R.F. et al, Modelling of a Magma Energy Geothermal Power Plant, presented at ASME Winter Annual Meeting, Boston MA, Dec. 1987, SAND-87-0564C, DE88 003793, 11 pages.

(Continued)

*Primary Examiner* — Zulmariam Mendez
(74) *Attorney, Agent, or Firm* — Kenneth M. Whitcomb

(57) ABSTRACT

A geothermally powered copper production system includes a geothermal system with a wellbore extending from a surface into an underground magma reservoir. A hopper receives a copper oxide ore that is crushed and provided to a leach heap to produce a copper-rich pregnant leach solution. The pregnant leach solution is provided to a settler that is heated by a heat transfer fluid heated by the geothermal system, and a product of the settler is used to prepare a copper product. A hopper receives a copper sulfide ore that is crushed and provided to a flotation tank. The flotation tank is heated by a heat transfer fluid heated by the geothermal system, and a product of the flotation tank is used to prepare a copper product.

26 Claims, 12 Drawing Sheets

(51) Int. Cl.
*C22B 15/06* (2006.01)
*C25C 3/34* (2006.01)

(56) References Cited

U.S. PATENT DOCUMENTS

| | | | | |
|---|---|---|---|---|
| 3,857,701 | A * | 12/1974 | Hunter | C22B 15/0052 75/643 |
| 3,864,208 | A | 2/1975 | Van | |
| 3,957,108 | A | 5/1976 | Huisen | |
| 4,043,129 | A | 8/1977 | McCabe et al. | |
| 4,054,176 | A | 10/1977 | Huisen | |
| 4,665,705 | A | 5/1987 | Bonham, Jr. | |
| 4,929,348 | A | 5/1990 | Rice | |
| 5,911,684 | A | 6/1999 | Shnell | |
| 7,124,584 | B1 | 10/2006 | Wetzel et al. | |
| 8,047,285 | B1 | 11/2011 | Smith | |
| 9,388,797 | B2 | 7/2016 | Bronicki | |
| 2006/0026961 | A1 | 2/2006 | Bronicki | |
| 2010/0045042 | A1 | 2/2010 | Hinders et al. | |
| 2013/0101492 | A1 | 4/2013 | McAlister | |
| 2013/0234444 | A1 | 9/2013 | Rogers et al. | |
| 2014/0262137 | A1 | 9/2014 | McBay | |
| 2015/0300327 | A1 | 10/2015 | Sweatman et al. | |
| 2016/0363350 | A1 | 12/2016 | Tahara | |
| 2018/0224164 | A1 | 8/2018 | Lakic | |
| 2020/0200438 | A1 * | 6/2020 | McBay | F03G 4/074 |
| 2023/0130169 | A1 | 4/2023 | McIntyre | |

FOREIGN PATENT DOCUMENTS

| | | | |
|---|---|---|---|
| JP | 2011052621 | A | 3/2011 |
| JP | 2014202149 | A | 10/2014 |
| JP | 2020067027 | A | 4/2020 |
| WO | 2012079078 | A2 | 6/2012 |
| WO | 2013025640 | A2 | 2/2013 |
| WO | 2016204287 | A1 | 12/2016 |
| WO | 2022211643 | A1 | 10/2022 |

OTHER PUBLICATIONS

Colp, John L., Final Report—Magma Energy Research Project, Sandia Report, Sand82-2377, Unlimited Release, UC-66, prepared by Sandia National Laboratories under contrace DE-AC04-76DP00789, Printed Oct. 1982, 42 pages.

* cited by examiner

GEOTHERMALLY POWERED PYROMETALLURGICAL COPPER PRODUCTION

TECHNICAL FIELD

The present disclosure relates generally to metal extraction and more particularly to copper production powered by geothermal energy.

BACKGROUND

Copper is produced by refinement through energy intensive processes involving heat and mechanical energy. Considerable energy is expended to supply heat and power the equipment used to perform such production. Renewable energy sources, such as solar power and wind power, can be unreliable and have relatively low power densities, such that they may be insufficient to reliably power copper production equipment. As such, production equipment typically relies on non-renewable fuels for power. There exists a need for improved copper production processes.

SUMMARY

This disclosure recognizes the previously unidentified and unmet need for a reliable renewable energy source for copper production. This disclosure provides a solution to this unmet need in the form of a copper production system that is powered at least partially by geothermal energy. A geothermal system harnesses heat from a geothermal resource with a sufficiently high temperature for driving processes performed by a copper production system. For example, steam may be obtained from a geothermal system and used to heat one or more reactor vessels to obtain copper from an initial ore provided to the copper production system. For instance, heated fluid from a geothermal system may be used to heat a heat exchanger to maintain appropriate temperatures for reactions in a flotation tank. As another example, heated fluid may be used to heat a roaster to facilitate desired oxidation reactions. In some cases, one or more geothermally powered motors may be powered with steam from a geothermal system and used to support mechanical operations of the copper production process, such as to crush and grind copper ores. As another example, the same or a different geothermally powered motor may power a pump and/or conveyor that is used to move materials between different process equipment for copper production. One or more turbines may be powered by the steam to provide electricity for any electronic components of the copper production system (e.g., electronic controllers, sensors, etc.).

In some embodiments, the geothermal system that powers the copper production system is a closed geothermal system that exchanges heat with an underground geothermal reservoir. The geothermal reservoir may be a magma reservoir. For example, an underground geothermal reservoir, such as a magma reservoir, may facilitate the generation of high-temperature, high-pressure steam, while avoiding problems and limitations associated with previous geothermal technology. The geothermal systems of this disclosure generally include a wellbore that extends from a surface into an underground thermal reservoir, such as a magma reservoir. A closed heat-transfer loop is employed in which a heat transfer fluid is pumped into the wellbore, heated via contact with the underground thermal reservoir, and returned to the surface to power a copper production system located within a sufficient proximity to the wellbore.

The geothermal system of this disclosure may harness a geothermal resource with sufficiently high amounts of energy from magmatic activity such that the geothermal resource does not degrade significantly over time. This disclosure illustrates improved systems and methods for capturing energy from magma reservoirs, dikes, sills, and other magmatic formations that are significantly higher in temperature than heat sources that are accessed using previous geothermal technologies and that can contain an order of magnitude higher energy density than the geothermal fluids that power previous geothermal technologies. In some cases, the present disclosure can significantly decrease copper production costs and/or reliance on non-renewable resources for copper production system operations. In some cases, the present disclosure may facilitate more efficient copper production in regions where access to reliable power is currently unavailable or transport of non-renewable fuels is challenging. The systems and methods of the present disclosure may also or alternatively aid in decreasing carbon emissions.

Certain embodiments may include none, some, or all of the above technical advantages. One or more technical advantages may be readily apparent to one skilled in the art from figures, description, and claims included herein.

BRIEF DESCRIPTION OF THE FIGURES

For a more complete understanding of the present disclosure, reference is now made to the following description, taken in conjunction with the accompanying drawings and detailed description, in which like reference numerals represent like parts.

DETAILED DESCRIPTION

Embodiments of the present disclosure and its advantages will become apparent from the following detailed description when considered in conjunction with the accompanying figures. In the figures, each identical, or substantially similar component that is illustrated in various figures is represented by a single numeral or notation. For purposes of clarity, not every component is labeled in every figure, nor is every component of each embodiment shown where illustration is not necessary to allow those of ordinary skill in the art to understand the disclosure.

The present disclosure includes unexpected observations, which include the following: (1) magma reservoirs can be located at relatively shallow depths of less than 2.5 km; (2) the top layer of a magma reservoir may have relatively few crystals with little or no mush zone; (3) rock near or around magma reservoirs may not be ductile and may support fractures; (4) a magma reservoir does not decline in thermal output over at least a two-year period; (5) eruptions at drill sites into magma reservoirs are unlikely (e.g., eruptions have not happened at African and Icelandic drill sites in over 10,000 years and it is believed a Kilauea, Hawaii drill site has never erupted); and (6) drilling into magma reservoirs can be reasonably safe.

As used herein, "magma" refers to extremely hot liquid and semi-liquid rock under the Earth's surface. Magma is formed from molten or semi-molten rock mixture found typically between 1 km to 10 km under the surface of the Earth. As used herein, "borehole" refers to a hole that is drilled to aid in the exploration and recovery of natural resources, including oil, gas, water, or heat from below the surface of the Earth. As used herein, a "wellbore" refers to a borehole either alone or in combination with one or more other components disposed within or in connection with the borehole in order to perform exploration and/or recovery processes. In some cases, the terms "wellbore" and "borehole" are used interchangeably. As used herein, "heat transfer fluid" refers to a fluid, e.g., a gas or liquid, that takes part in heat transfer by serving as an intermediary in cooling on one side of a process, transporting and storing thermal energy, and heating on another side of a process. Heat transfer fluids are used in processes requiring heating or cooling.

Figure 1:
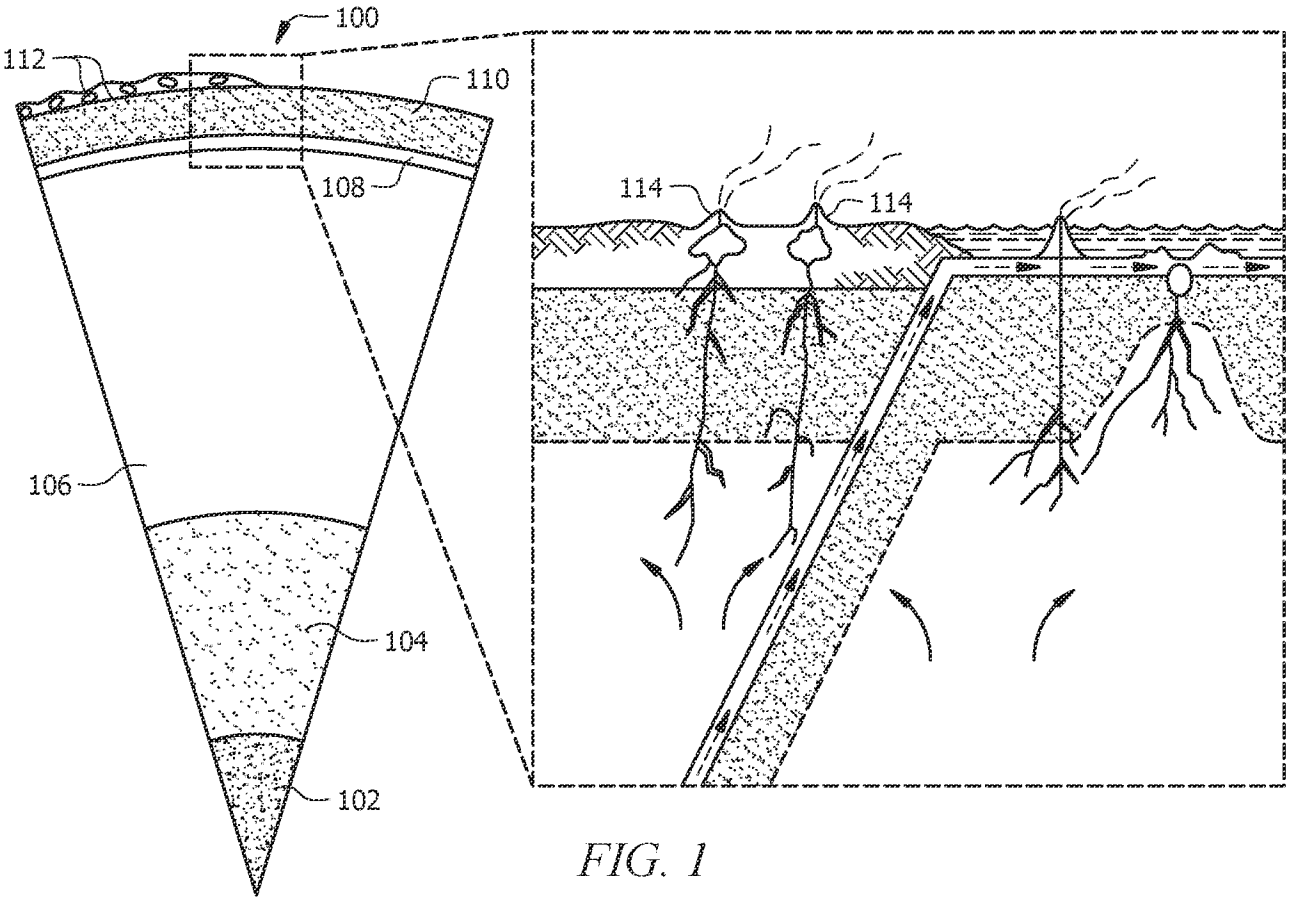
FIG. 1 is a diagram of underground regions near a tectonic plate boundary in the Earth.

FIG. 1 is a partial cross-sectional diagram of the Earth depicting underground formations that can be tapped by geothermal systems of this disclosure (e.g., for generating geothermal power). The Earth is composed of an inner core 102, outer core 104, lower mantle 106, transition zone 108, upper mantle 110, and crust 112. There are places on the Earth where magma reaches the surface of the crust 112 forming volcanoes 114. However, in most cases, magma approaches only within a few miles or less from the surface. This magma can heat ground water to temperatures sufficient for certain geothermal power production. However, for other applications, such as geothermal energy production, more direct heat transfer with the magma is desirable.

Figure 2:
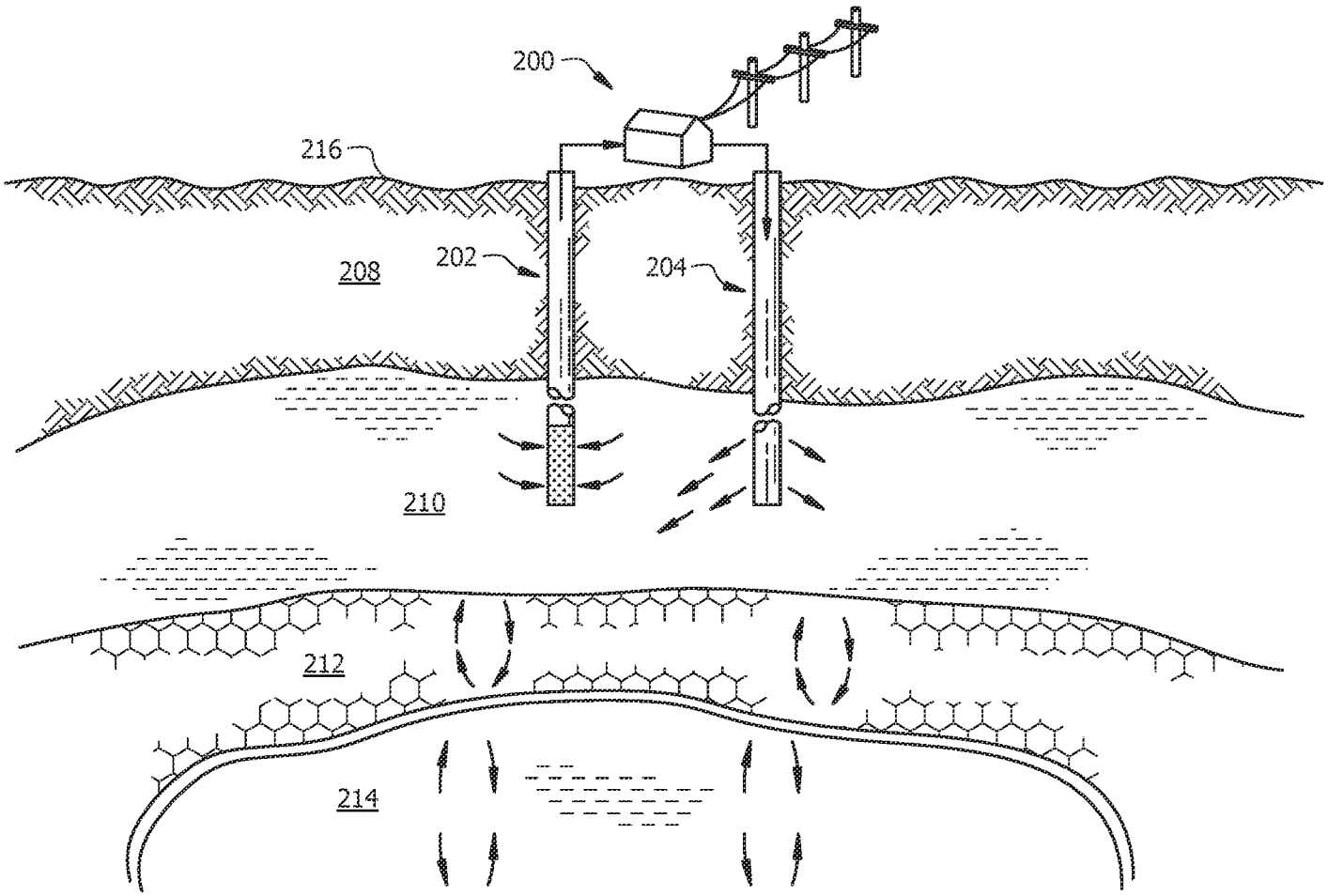
FIG. 2 is a diagram of a conventional geothermal system.

FIG. 2 illustrates a conventional geothermal system 200 that harnesses energy from heated ground water for power generation. The conventional geothermal system 200 is a "flash-plant" that generates power from a high-temperature, high-pressure geothermal water extracted from a production well 202. The production well 202 is drilled through rock layer 208 and into the geothermal fluid layer 210 that serves as the source of geothermal water. The geothermal water is heated indirectly via heat transfer with intermediate layer 212, which is in turn heated by magma reservoir 214. Convective heat transfer (illustrated by the arrows indicating that hotter fluids rise to the upper portions of their respective layers before cooling and sinking, then rising again) may facilitate heat transfer between these layers. Geothermal water from the geothermal fluid layer 210 flows to the surface 216 and is used for geothermal power generation. The geothermal water (and possibly additional water or other fluids) is then injected back into the geothermal fluid layer 210 via an injection well 204.

The configuration of conventional geothermal system 200 of FIG. 2 suffers from drawbacks and disadvantages, as recognized by this disclosure. For example, the system 200 may not achieve sufficiently high temperatures to facilitate efficient copper production. As another example, because geothermal water is a polyphase mixture (i.e., not pure water), the geothermal water flashes at various points along its path up to the surface 216, creating water hammer, which results in a large amount of noise and potential damage to system components. The geothermal water is also prone to causing scaling and corrosion of system components. Chemicals may be added to partially mitigate these issues, but this may result in considerable increases in operational costs and increased environmental impacts, since these chemicals are generally introduced into the environment via injection well 204.

Example Improved Geothermal System

Figure 3:
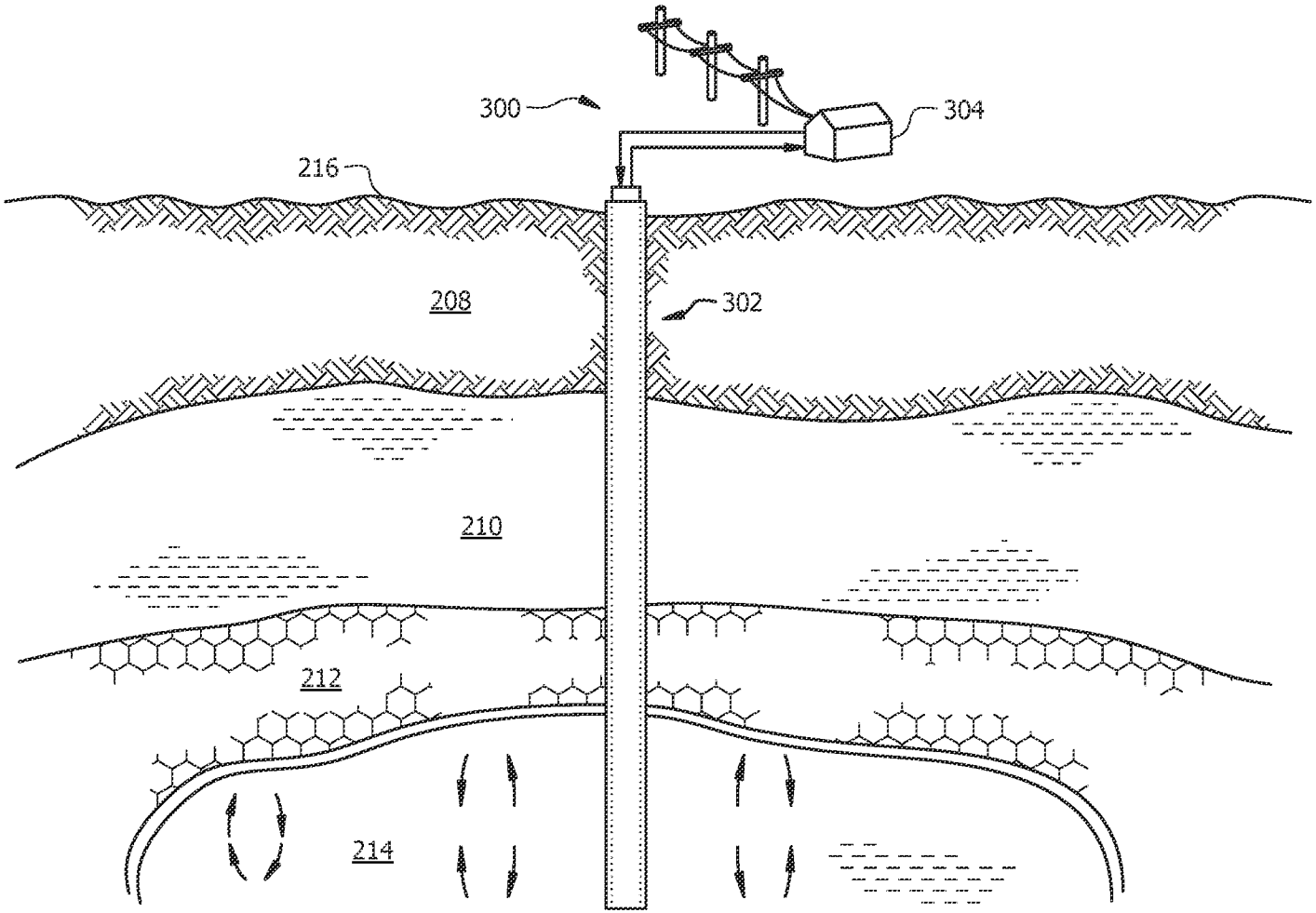
FIG. 3 is a diagram of an example improved geothermal system of this disclosure.

FIG. 3 illustrates an example magma-based geothermal system 300 of this disclosure. The magma-based geothermal system 300 includes a wellbore 302 that extends from the surface 216 at least partially into the magma reservoir 214. The magma-based geothermal system 300 is a closed system in which a heat transfer fluid is provided down the wellbore 302 to be heated and returned to a thermal process system 304 (e.g., for power generation and/or any other thermal processes of interest). As such, geothermal water is not extracted from the Earth, resulting in significantly reduced risks associated with the conventional geothermal system 200 of FIG. 2, as described further below. Heated heat transfer fluid is provided to the thermal process system 304. The thermal process system 304 is generally any system that uses the heat transfer fluid to drive a process of interest. For example, the thermal process system 304 may include an electricity generation system support thermal processes requiring higher temperatures/pressures than could be reliably or efficiently obtained using previous geothermal technology, such as the conventional geothermal system 200 of FIG. 2. Further details of components of an example thermal process system 304 are provided with respect to FIG. 9 below.

The magma-based geothermal system 300 provides technical advantages over previous geothermal systems, such as the conventional geothermal system 200 of FIG. 2. The magma-based geothermal system 300 can achieve higher temperatures and pressures for increased energy generation (and/or for more effectively driving other thermal processes). For example, because of the high energy density of magma in magma reservoir 214 (e.g., compared to that of geothermal water of the geothermal fluid layer 210), wellbore 302 can generally create the power of many wells of the conventional geothermal system 200 of FIG. 2. Furthermore, the magma-based geothermal system 300 has little or no risk of thermal shock-induced earthquakes, which might be attributed to the injection of cooler water into a hot geothermal zone, as is performed using the conventional geothermal system 200 of FIG. 2. The heat transfer fluid is generally not substantially released into the geothermal zone, resulting in a decreased environmental impact and decreased use of costly materials (e.g., chemical additives that are used and introduced to the environment in great quantities during some conventional geothermal operations). The magma-based geothermal system 300 may also have a simplified design and operation compared to those of previous systems. For instance, fewer components and reduced complexity may be needed at the thermal process system 304 because only clean heat transfer fluid (e.g., steam) reaches the surface 216. There may be no need or a reduced need to separate out solids or other impurities that are common to geothermal water. The example magma-based geothermal system 300 may include further components not illustrated in FIG. 3.

Further details and examples of different configurations of geothermal systems and methods of their preparation and operation are described in U.S. patent application Ser. No. 18/099,499, filed Jan. 20, 2023, and titled "Geothermal Power from Superhot Geothermal Fluid and Magma Reservoirs"; U.S. patent application Ser. No. 18/099,509, filed Jan. 20, 2023, and titled "Geothermal Power from Superhot Geothermal Fluid and Magma Reservoirs"; U.S. patent application Ser. No. 18/099,514, filed Jan. 20, 2023, and titled "Geothermal Power from Superhot Geothermal Fluid and Magma Reservoirs"; U.S. patent application Ser. No. 18/099,518, filed Jan. 20, 2023, and titled "Geothermal Power from Superhot Geothermal Fluid and Magma Reservoirs"; U.S. patent application Ser. No. 18/105,674, filed Feb. 3, 2023, and titled "Wellbore for Extracting Heat from Magma Chambers"; U.S. patent application Ser. No. 18/116,693, filed Mar. 2, 2023, and titled "Geothermal Systems and Methods With an Underground Magma Chamber"; U.S. patent application Ser. No. 18/116,697, filed Mar. 2, 2023, and titled "Method and System for Preparing a Geothermal System with a Magma Chamber"; and U.S. Provisional Patent Application No. 63/444,703, filed Feb. 10, 2023, and titled "Geothermal Systems and Methods Using Energy from Underground Magma Reservoirs", the entirety of each of which is hereby incorporated by reference.

Geothermally Powered Copper Production

Figure 4:
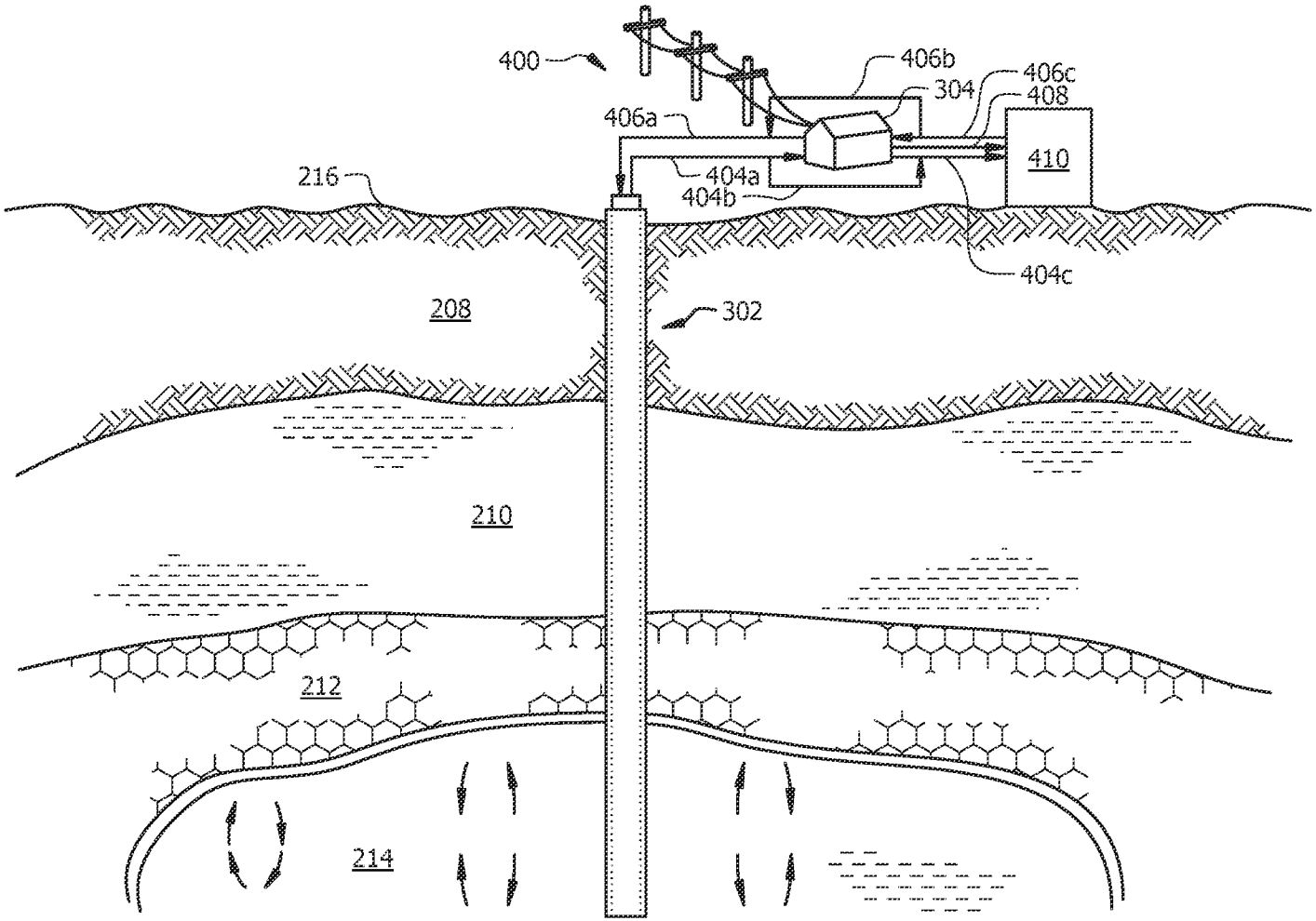
FIG. 4 is a diagram of an example system in which copper production is powered by the improved geothermal system of FIG. 3.

FIG. 4 illustrates an example combined geothermal and copper production system 400 of this disclosure. The combined geothermal and copper production system 400 includes all or a portion of the components of the magma-based geothermal system 300 described above with respect to FIG. 3, as well as geothermally powered copper production system 410. The geothermally powered copper production system 410 may include a geothermally powered hydrometallurgical copper production system (e.g., system 500 of FIG. 5) for producing copper using hydrometallurgical methods and/or a geothermally powered pyrometallurgical copper production system (e.g., system 700 of FIG. 7) for producing copper using pyrometallurgical methods. The combined geothermal and copper production system 400 may include all or a portion of the thermal process system 304.

In operation, heat transfer fluid is injected into the wellbore 302, which extends from the surface 216 into the magma reservoir 214 underground. The heated heat transfer fluid can be conveyed to the thermal process system 304 as heat transfer fluid 404*a* that can be used to drive processes, such as the generation of electricity 408 by turbines 904 and 908 in FIG. 9. Heat transfer fluid 404*a* may be referred to in the alternative as a stream of heat transfer fluid 404*a*. Heat transfer fluid 404*c*, which can be formed from any remaining amount of heat transfer fluid 404*a* (e.g., steam) exiting from the thermal process system 304 and/or the wellbore bypass stream, i.e., heat transfer fluid 404*b*, is provided to the geothermally powered copper production system 410. The electricity 408 may be used in addition to or in place of heat transfer fluid 404*c* for powering electrical and mechanical processes in the geothermally powered copper production system 410.

As described in greater detail below with respect to FIGS. 5 and 7, the geothermally powered copper production system 410 can use the heat transfer fluid 404*c* to drive hydrometallurgical and/or pyrometallurgical processes to produce copper. For example, a motor of the geothermally powered hydrometallurgical copper production system may be powered by the heat transfer fluid 404*c*, and the motor may provide motion to a hopper, crusher, conveyor, fluid pump(s), and/or the like (see FIG. 5 and corresponding descriptions below). As another example, a geothermally powered hydrometallurgical copper production system may include a fluid pump with a motor that is powered at least in part by the heat transfer fluid (e.g., steam) heated in the wellbore 302. As another example, a geothermally powered hydrometallurgical copper production system may include a motor that aids in moving a mixer in a flotation tank and is powered by heat transfer fluid (e.g., steam) heated in the wellbore 302.

In some cases, cooling may be desirable for certain processes. An absorption chiller may use heated fluid from the geothermal system to provide such cooling. In some cases, temperature adjustments or control may be achieved using heated fluid from the geothermal system and/or cooling from a geothermally powered absorption chiller. In this way, for example, smelting can be improved by operating at a temperature that facilitates more effective electrolytic reduction. More generally, reaction conditions can be adjusted to improve production of copper using hot or cold fluid obtained via geothermal energy with limited or no use of other energy inputs, and by using a temperature control system to maintain the temperature between a desired minimum and maximum values to improve product yield and to reduce the generation of unwanted byproducts. More detailed examples of operations of a geothermally powered hydrometallurgical copper production system and geothermally powered pyrometallurgical copper production system are provided below with respect to FIGS. 5 and 7, respectively.

Heat transfer fluid (e.g., condensed steam) that is cooled and/or decreased in pressure after powering the geothermally powered copper production system 410 may be returned to the wellbore 302 as heat transfer fluid 406*a*. For instance, as shown in the example of FIG. 4, a stream of return heat transfer fluid 406*c* may be provided back to the thermal process system 304, used to drive one or more reactions or processes, and then expelled as heat transfer fluid 406*a* for return to the wellbore 302. The heat transfer fluid 406*a* can also include a bypass stream of heat transfer fluid 406*b*, which can be formed from heat transfer fluid 406*c*, in whole or in part. Restated, thermally processed return stream of heat transfer fluid 406*a* includes heat transfer fluid (e.g., condensed steam) from the thermal process system 304 and/or the bypass stream of heat transfer fluid 406*b*. Thermally processed return stream of heat transfer fluid 406*a* that is sent back to the wellbore 302 may be water (or another heat transfer fluid), while the stream of heat transfer fluid 404*a* received from the wellbore 302 is steam (or another heat transfer fluid at an elevated temperature and/or pressure). While the example of FIG. 4 includes the thermal process system 304 of FIG. 3, in some cases, the combined geothermal and copper production system 400 may exclude all or a portion of the thermal process system 304. For example, the wellbore stream of heat transfer fluid 404*a* from the wellbore 302 may be provided directly to the geothermally powered copper production system 410 (see wellbore bypass stream of heat transfer fluid 404*b* described above).

Heat transfer fluid in streams 404*a-c* and 406*a-c* may be any appropriate fluid for absorbing heat within the wellbore 302 and driving operations of the geothermally powered copper production system 410 and, optionally the thermal process system 304. For example, the heat transfer fluid may include water, a brine solution, one or more refrigerants, a thermal oil (e.g., a natural or synthetic oil), a silicon-based fluid, a molten salt, a molten metal, or a nanofluid (e.g., a carrier fluid containing nanoparticles). A molten salt is a salt that is a liquid at the high operating temperatures experienced in the wellbore 302 (e.g., at temperatures between 1,600° F. and 2,300° F.). In some cases, an ionic liquid may be used as the heat transfer fluid. An ionic liquid is a salt that remains a liquid at more modest temperatures (e.g., at or near room temperature). In some cases, a nanofluid may be used as the heat transfer fluid. The nanofluid may be a molten salt or ionic liquid with nanoparticles, such as graphene nanoparticles, dispersed in the fluid. Nanoparticles have at least one dimension of 100 nanometers (nm) or less. The nanoparticles increase the thermal conductivity of the molten salt or ionic liquid carrier fluid. This disclosure recognizes that molten salts, ionic liquids, and nanofluids can provide improved performance as heat transfer fluids in the wellbore 302. For example, molten salts and/or ionic liquids may be stable at the high temperatures that can be reached in the wellbore 302. The high temperatures that can be achieved by these materials not only facilitate increased energy extraction but also can drive thermal processes that were previously inaccessible using previous geothermal technology. The heat transfer fluid may be selected at least in part to limit the extent of corrosion of surfaces of the combined geothermal and copper production system 400. As an example, the heat transfer fluid may be water. The water is supplied to the wellbore 302 as stream of heat transfer fluid 406*a* in the liquid phase and is transformed into steam within the wellbore 302. The steam is received as a stream of heat transfer fluid 404*a* and used to drive the geothermally powered copper production system 410.

Example Geothermally Powered Hydrometallurgical Copper Production System

Figure 5:
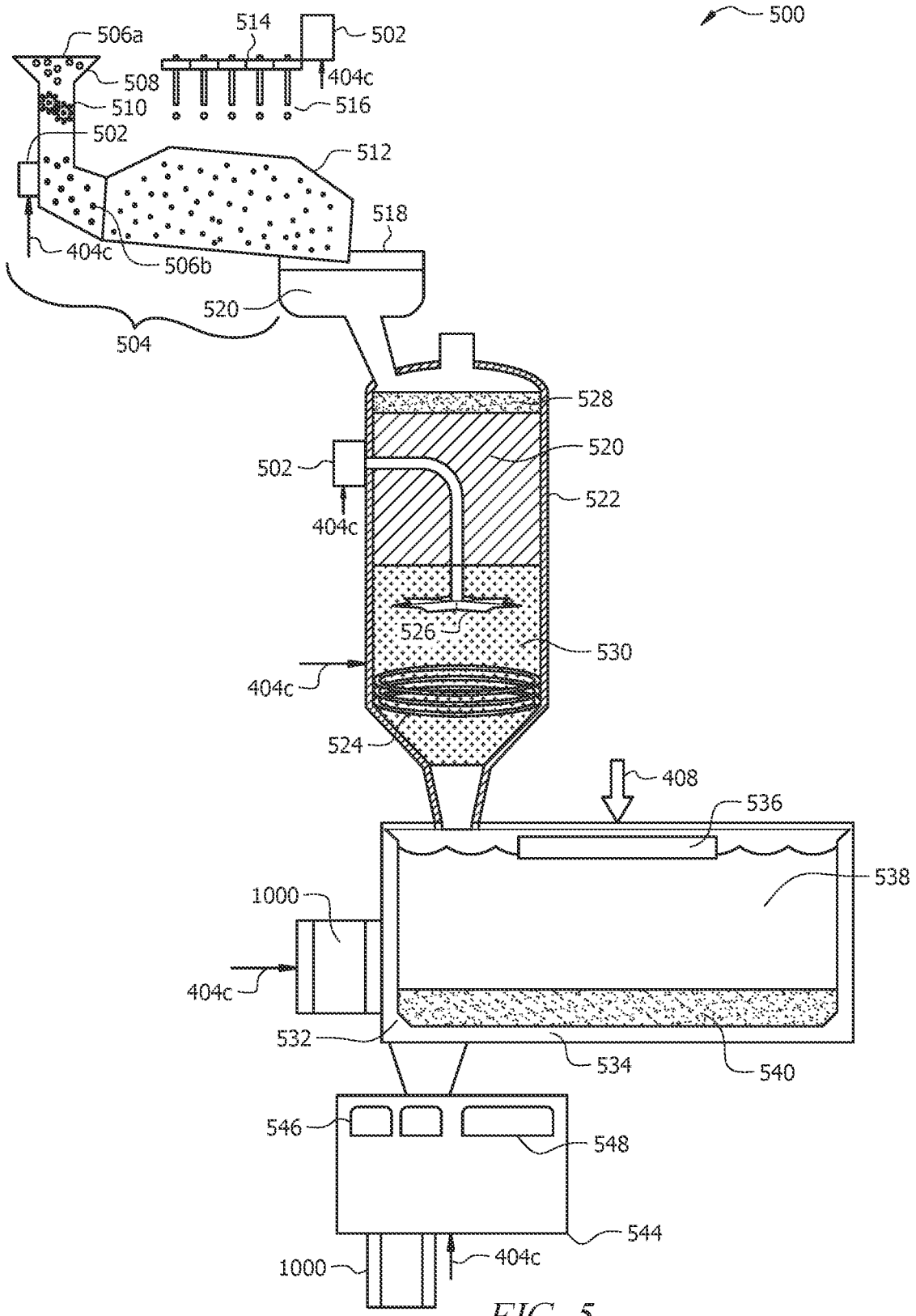
FIG. 5 is a diagram of an example geothermally powered hydrometallurgical copper production system that may be used as the copper production system of FIG. 4. The geothermally powered hydrometallurgical copper production system extracts copper-bearing materials from copper oxide ore using a hydrometallurgical process.

FIG. 5 shows an example of a geothermally powered hydrometallurgical copper production system 500 that can be used as part of the system 410 FIG. 4. The configuration of FIG. 5 is provided as an example only. The geothermally powered hydrometallurgical copper production system 500 may include more or fewer components, and the components may be arranged in different configurations to produce copper product 548. The example geothermally powered hydrometallurgical copper production system 500 includes a leaching system 504, a hopper 508, a crusher 510, a leach heap 512, a sprinkler 514, a settler 522, an electrolytic smelter 532, and a foundry 544. These main components and other components may be powered at least partially by geothermal energy from the heat transfer fluid 404*c* (e.g., steam). This heat transfer fluid 404*c* may be used directly to heat components in geothermally powered hydrometallurgical copper production system 500 or to heat a secondary heat transfer fluid. The secondary heat transfer fluid may be any similarly suitable fluid as chosen in the primary heat transfer fluid 404*c*. The heat transfer fluid 404*c* or secondary heat transfer fluid may be used to heat components or may be converted to mechanical or electrical energy to perform operations in the geothermally powered hydrometallurgical copper production system 500. The geothermally powered hydrometallurgical copper production system 500 extracts copper-bearing materials from copper oxide ore 506*a* (i.e., copper-bearing oxide minerals) to produce a copper-rich solution that is used to produce copper using hydrometallurgical systems and methods.

During operation of the geothermally powered hydrometallurgical copper production system 500, a copper oxide ore 506*a* enters the hopper 508 and is crushed and ground by the crusher 510. Copper may be extracted from any number of copper oxide ores, such as cuprite ($Cu_2O$), azurite ($Cu_3(CO_3)_2(OH)_2$) and malachite ($CuzCO_3(OH)_2$). The hopper 508 can be any appropriate type of open funnel that receives copper oxide ore 506*a*. It may contain a screen or a feeder. A geothermally powered motor 502 coupled to the crusher 510 may power the crusher 510. The geothermally powered motor 502 can be coupled to system components, such as the crusher 510, using conventional means, e.g., mechanical, electrical, pneumatic, etc., which are omitted for the sake of simplicity. The crusher 510 can be any appropriate type of machine that operates by rolling, impacting, milling, vibrating, and/or grinding. For example, the crusher may be a jaw crusher, impact crusher, or ball mill. The geothermally powered motor 502 may be powered directly by the heat transfer fluid 404*c* that is heated by the magma reservoir 214 or using electricity 408. An example of geothermally powered motor is described in U.S. Provisional Patent Application No. 63/448,929, filed Feb. 28, 2023, and titled "Drilling Equipment Powered by Geothermal Energy," the entirety of which is incorporated herein by reference.

The crushed copper oxide ore 506*b* is added to the leach heap 512 to be leached to produce a leach solution 520. The leach heap 512 is a surface that can accommodate receiving and accumulating the crushed copper oxide ore 506*b* and can accommodate receiving a leaching reagent 516. The leach heap 512 can direct flow (e.g., via positioning of the surface at an angle to utilize gravity) of the leaching reagent 516 (and the leach solution 520 as it is produced) toward an area to be collected. In exemplary embodiments, the leaching reagent 516 can be steadily applied to the leach heap 512 over a period between 45 and 120 days.

A sprinkler 514 applies the leaching reagent 516 to the crushed copper oxide ore 506*b* in the leach heap 512. The sprinkler 514 can be any device that utilizes piping, fittings, and valves configured in a way that facilitates flow of the leaching reagent 516 to the leach heap 512. As examples, a sprinkler may emit the leaching reagent 516 by a drip emitter, an impact sprinkler, or a wobbler. An impermeable liner (e.g., reinforced polyethylene) is positioned at the base of the leach heap 512 to capture the leach solution 520 that percolates through the leach heap 512. The leaching reagent 516 is any chemical or chemicals capable of extracting copper from the crushed copper oxide ore 506*b* and producing the leach solution 520. An example of a leaching reagent is diluted sulfuric acid. An example reaction is $Cu_2O+H_2SO_4 \rightarrow CuSO_4+Cu+H_2O$. The resulting leach solution 520 contains the leaching reagent 516 and copper and/or copper compound(s) (e.g., copper sulfate). Copper may be present in the leach solution 520 at concentrations from around 60% to 70%. The leach solution 520 is then collected in a collection ditch (e.g., a pond or pool). The collection ditch 518 can be any container capable of collecting the leach solution 520 and holding it until ready for further processing.

The leach solution 520 is processed by solvent extraction in a settler 522. The settler 522 may be any vessel or vessels capable of containing the leach solution 520 produced in the leach heap 512 and facilitating heating and mixing with a solvent to extract copper from the leach solution 520 to produce a copper sulfate solution 530. In FIG. 5, the settler 522 is depicted as a single vessel for simplicity, but in other embodiments there may be additional vessels used to facilitate solvent extraction as mixing and settling in separate vessels. During the solvent extraction, the leach solution 520 (e.g., aqueous solution) is added to the settler 522 along with a solvent 528 (e.g., organic solvent). These two immiscible liquids are mixed by using a mixer 526 then allowed to separate causing the copper to move from the leach solution 520 to the solvent 528. An example reaction is $(2RH)(org)+CuSO_4\ (aq)\rightarrow(R_2Cu)(org)+H_2SO_4$, where R is a functional group (e.g., an alkyl group).

The settler 522 can be heated (e.g., about 25° C. to 40° C.) by a heat exchanger 524, which can be heated by heat transfer fluid 404*c*. The heat exchanger 524 is depicted as disposed proximal to the settler 522 in FIG. 5 to provide heat to the walls of the settler 522 to indirectly heat the leach solution 520 and the solvent 528, but in other embodiments the heat exchanger 524 can be positioned within the settler 522 which can then directly heat the leach solution 520 and the solvent 528. Heat exchange between the heat exchanger 524 and the leach solution 520 and the solvent 528 may maintain an optimal temperature range for the solvent extraction. Examples of the heat exchanger 524 include shell-and-tube or tube-in-tube type heat exchangers.

A mixer 526 is used to enhance agitation of the leach solution 520 and the solvent 528. The mixer 526 is any machine capable of agitating the leach solution 520 and the solvent 528 contained by the settler 522. In the example of FIG. 5, a geothermally powered motor 502 rotates the mixer 526. The mixer 526 may include beaters, paddles, propellers, hydrofoils, or turbines, as examples. After mixing the leach solution 520 and the solvent 528 and allowing to settle, the solvent 528 contains copper. The solvent 528 can then be treated with an acid (e.g., sulfuric acid) to produce a more concentrated copper sulfate solution 530 than before.

The copper sulfate solution 530 can be electrolytically reduced via the electrowinning process or another appropriate process in an electrolytic smelter 532. Electrolytic reduction is driven by a current between a cathode 534 which lines the smelting bath 538 and an anode 536. Example materials that may be used for the cathode 534 are copper tubes, copper blocks, or stainless steel and for the anode 536 are copper, lead, titanium, or stainless steel. The cathode 534 may be coated with graphite to ease the removal of a copper coating 540 once it is produced. The copper sulfate solution 530 acts as an electrolyte (i.e., copper (II) ions) and is fed into the smelting bath 538 using conventional means that are omitted for the sake of simplicity. Electrolysis causes a copper coating 540 to deposit on the cathode 534 by the reaction $Cu^{2+}+2e^{-}\rightarrow Cu(s)$ and copper to enter solution from the anode 536 by a reaction $Cu(s)\rightarrow Cu^{2+}+2e^{-}$.

This example reaction for electrolytic reduction may be maintained at an optimal temperature range (e.g., 40-60° C.). To achieve this, the electrolytic smelter 532 may be heated or cooled accordingly, as needed, to maintain the temperature in the electrolytic smelter 532 at a target temperature or within a target temperature range. A temperature setpoint is maintained by a temperature control system (e.g., temperature control system 1000 of FIG. 10) positioned within or proximate to the electrolytic smelter 532.

Electrolysis requires a high energy demand. This disclosure provides a solution to this problem by facilitating the operation of the electrolytic smelter 532 using geothermal energy. For example, the current used for electrolysis may be supplied by electricity 408 derived from the conversion of heat in the heat transfer fluid 404*c* by turbines (e.g., turbines 904, 908 of FIG. 9), and the smelting bath 538 is heated by a heat transfer fluid 404*c* to help improve electrolytic efficiency.

The copper coating 540 is removed at intervals (e.g., every 24 to 48 hours) using conventional means that are omitted for the sake of simplicity. The copper coating 540 may be melted in a foundry 544 to produce molten copper 546. The foundry 544 can be any vessel capable of receiving and containing the molten copper 546, cooling the molten copper 546, and forming it into masses of various shapes and sizes. The foundry 544 may be heated by the heat transfer fluid 404*c* in a similar manner that the settler 522 is heated by the heat transfer fluid 404*c*. The final copper product 548 may be cast into any desired shape, for example, ingots, slabs, billets, and t-bars.

Example Method of Geothermally Powered Hydrometallurgical Copper Production

Figure 6:
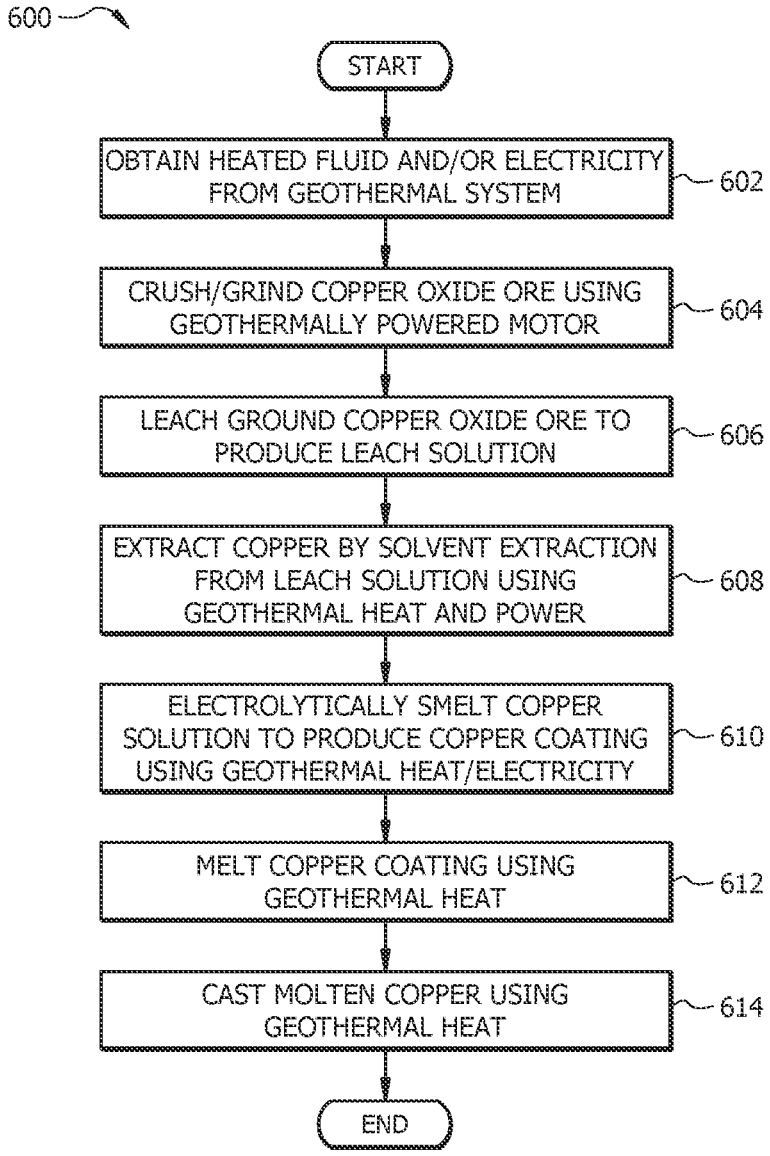
FIG. 6 is a flowchart of an example method for operating the hydrometallurgical system of FIG. 5.

FIG. 6 shows an example method 600 of operating the geothermally powered hydrometallurgical copper production system 500 in FIG. 5. The method 600 may begin at step 602. At step 602, the heated heat transfer fluid 404*c* and/or electricity 408 are received from the geothermal system, as described above with respect to FIGS. 1-4. At step 604, copper oxide ore is crushed and/or ground using a geothermally powered motor 502 to produce a ground copper oxide ore. At step 606, a leach solution 520 is produced by applying leaching reagents 516 using a sprinkler 514 to the ground copper oxide ore and allowing the leaching reagents 516 to percolate through the ground copper oxide ore. At step 608, copper is extracted by combining and mixing the leach solution 520 with a solvent 528 and heating the resulting mixture with the heat transfer fluid 404*c* to produce a copper sulfate solution 530. At step 610, an electrolytic smelter 532 reduces the copper solution causing a copper coating to deposit on a cathode. Step 610 may be driven by current between the anode and the cathode described in FIG. 5, the current being generated by electricity 408 from the geothermally powered turbines 904, 908 configured to use the heat transfer fluid 404*c* heated by the geothermal system. At step 612, the copper coating is heated by the heat transfer fluid 404*c* to produce molten copper. At step 614, the molten copper is cast in a foundry 544.

Modifications, omissions, or additions may be made to method 600 depicted in FIG. 6. Method 600 may include more, fewer, or other steps. For example, at least certain steps may be performed in parallel or in any suitable order. While at times discussed as geothermally powered hydrometallurgical copper production system 500 performing steps, any suitable component of the geothermally powered hydrometallurgical copper production system 500 or other components of a geothermal system may perform or may be used to perform one or more steps of the method 600.

Example Geothermally Powered Pyrometallurgical Copper Production System

Figure 7:
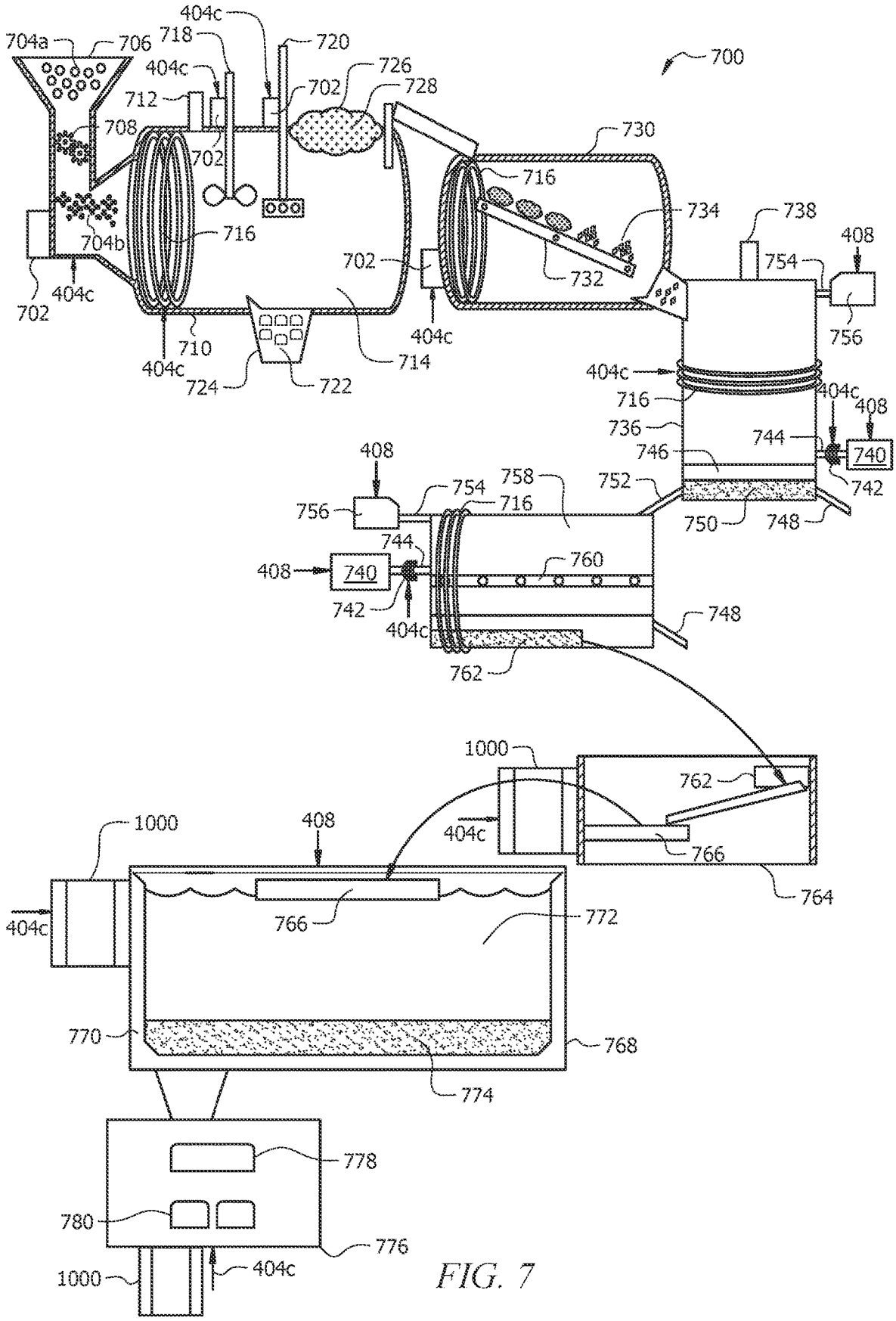
FIG. 7 is a diagram of an example geothermally powered pyrometallurgical copper production system that may be used as the copper production system of FIG. 4. The system of FIG. 7 extracts copper-bearing materials from copper sulfide ore using a pyrometallurgical process.

FIG. 7 shows an example of a geothermally powered pyrometallurgical copper production system 700 that can be used as the system 410 of FIG. 4. The configuration of FIG. 7 is provided as an example only. The geothermally powered pyrometallurgical copper production system 700 may include more or fewer components, and the components may be arranged in different configurations in order to produce copper product 784. The example geothermally powered pyrometallurgical copper production system 700 includes a hopper 706, a crusher 708, a flotation tank 710, a roaster 730, a smelting furnace 736, a converter 758, an anode smelter 764, an electrolytic smelter 768, and a foundry 780. These main components and other components may be powered at least partially by geothermal energy from the heat transfer fluid 404*c* (e.g., steam). This heat transfer fluid 404*c* may be used directly to heat components in the geothermally powered pyrometallurgical copper production system 700 or to heat a secondary heat transfer fluid. The secondary heat transfer fluid may be any similarly suitable fluid as chosen in the primary heat transfer fluid 404*c*. The heat transfer fluid 404*c* or secondary heat transfer fluid may be used to heat components or may be converted to mechanical or electrical energy to perform operations in the geothermally powered pyrometallurgical copper production system 700. The geothermally powered pyrometallurgical copper production system 700 extracts copper-bearing materials from copper sulfide ore 704*a* (i.e., copper-bearing sulfide minerals) to produce a copper-rich froth 726 that is used to produce copper using pyrometallurgical systems and methods.

During operation of the geothermally powered pyrometallurgical copper production system 700, a copper sulfide ore 704*a* enters a hopper 706 and is crushed and ground by the crusher 708. Copper may be extracted from any number of copper sulfide ores, such as chalcopyrite ($CuFeS_2$) and chalcocite ($Cu_2S$). The hopper 706 can be any appropriate type of open funnel that receives copper sulfide ore 704*a*. It may contain a screen or a feeder. A geothermally powered motor 702 may be coupled to the crusher 708 to power the crusher 708. The geothermally powered motor 702 can be coupled to system components, such as the crusher 708, using conventional means, e.g., mechanical, electrical, pneumatic, etc., which are omitted for the sake of simplicity. The crusher 708 can be any appropriate type of machine that operates by rolling, impacting, milling, vibrating, and/or grinding. For example, the crusher 708 may be a jaw crusher, impact crusher, or ball mill. The geothermally powered motor 702 may be geothermally powered directly by the heat transfer fluid 404*c* that is heated by the magma reservoir 214. An example of geothermally powered motor is described in U.S. Provisional Patent Application No. 63/448,929, filed Feb. 28, 2023, and titled "Drilling Equipment Powered by Geothermal Energy," already incorporated herein by reference.

A ground copper sulfide 704*b* enters the flotation tank 710 to be processed into a slurry 714. The flotation tank 710 is any vessel that can accommodate input of reagents and can be maintained at a desired temperature to facilitate the extraction of copper materials from the ground copper sulfide 704*b*. The flotation tank 710 combines the ground copper sulfide 704*b* with flotation reagents 712 and water. The flotation reagents 712 and water can be introduced into the flotation tank 710 via conventional means and are omitted for the sake of simplicity. The flotation reagents 712 are any chemical capable of selectively separating hydrophobic materials from hydrophilic materials in the slurry 714, based on the differences in wettabilities of different materials. Examples of flotation reagents 712 are frothers (permit and stabilize bubble formation), promoters or collectors (decrease the wettability of the desired mineral), modifiers (increase wettability of the undesired mineral), depressors (render floatable minerals unfloatable), or activators (render unfloatable minerals, previously rendered so by depressors, floatable). Flocculants or coagulants may also be used to cause desired or undesired minerals to clump.

Example collectors for sulfide minerals are xanthates. Xanthates may be used for copper sulfides, due to their high selectivity for sulfide minerals. Xanthates chemically react with sulfide surfaces and do not react appreciably with non-sulfide byproducts 722. In the example of FIG. 5, sodium ethyl xanthate ($CH_3CH_2OCS_2Na$) may be one of the flotation reagents 712. The $OCSS^-$ group of sodium ethyl xanthate irreversibly attaches to the sulfide mineral surface, rendering the sulfide hydrophobic. Additional flotation reagents 712 may be added to the slurry 714 to adjust for varying mineral constituents present in the ground copper sulfide 704*b* (e.g., iron, lead, copper), and may be added simultaneously or stepwise. Additional flotation tanks 710 may be used to float different target metals (e.g., iron, lead, copper) and remove different byproducts using different flotation reagents 712. For example, a flotation tank 710 may be used to float iron prior to floating copper, in which appropriate flotation reagents 712 are used to target iron. Such a flotation tank 710 may be used before or after or simultaneously to one or more additional flotation tanks to extract copper and other metals that may be present in the ore. Copper oxide ores may be processed in a similar system using flotation reagents appropriate for targeting oxides (e.g., sodium salt of crude or refined petroleum sulfonic acids).

The flotation tank 710 is maintained at an elevated temperature appropriate for the mineral content of the ground copper sulfide 704*b* (e.g., about 45° C.) and a pH (e.g., in a range from 5 to 11.5). The elevated temperature of the flotation tank 710 can be provided by a heat exchanger 716, which can be heated by the heat transfer fluid 404*c*. The heat exchanger 716 is depicted as disposed within the flotation tank 710 in FIG. 7 to provide heat directly to the slurry 714, but in other embodiments the heat exchanger 716 can be arranged to heat the walls of the flotation tank 710 which can then heat the slurry 714. Heat exchange between the heat exchanger 716 and the slurry 714 and/or flotation tank 710 induces a reaction to form a froth 726 containing copper particles 728. Examples of the heat exchanger 716 include shell-and-tube or tube-in-tube type heat exchangers. A mixer 718 and an air intake 720 may be used to enhance agitation of the slurry 714. The mixer 718 is any machine capable of agitating the slurry 714 contained by the flotation tank 710. In the example of FIG. 7, a geothermally powered motor 702 rotates the mixer 718. The mixer 718 may be beaters, paddles, propellers, hydrofoils, or turbines, as examples. The air intake 720 is any machine capable of introducing air into the slurry 714 contained by the flotation tank 710. In the example of FIG. 7, a geothermally powered motor 702 powers the air intake 720. The air intake 720 may be aerators, bubblers, or spargers, as examples. During flotation in the flotation tank 710, byproducts 722 (e.g., iron) may be removed from the slurry 714 where at least a portion may be transferred to a waste collection reservoir 724.

The froth 726 containing copper particles 728 is then heated in the roaster 730 to convert it to copper sulfide 734. The roaster 730 is any vessel that can be heated and can receive and handle the copper particles 728. The roaster 730 is heated by heat transfer fluid 404*c*. A conveyor 732 conveys the copper particles 728 through the roaster 730 during the roasting process across the length of the chamber and is driven by a geothermally powered motor 702. The conveyor 732 can convey the copper particles 728 by a rolling motion, sliding motion, or radial motion, for example, along a belt or roller system, or moved in a fluidized bed. The roaster 730 can be a reverberating furnace, multiple-hearth roaster, a suspension roaster, or a fluidized-bed roaster, and heats the copper particles 728 to temperatures up to 1000° C. Roasting causes an oxidation reaction $CuFeS_2+3O_2 \rightarrow 2FeO+2CuS+2SO_2$. Copper sulfide 734 is a product of this process.

The copper sulfide 734 is received by the smelting furnace 736 where it may be further processed by smelting with heat. The smelting furnace 736 is any vessel that can be heated and can receive and process the copper sulfide 734. The copper sulfide 734 contains up to 30% copper. Smelting in the smelting furnace further increases purity of the copper sulfide 734 to up to 70% copper prior to treatment in a converter. The temperature of the smelting furnace 736 is maintained at an elevated temperature (e.g., 2300° C.). Heat can be provided at least in part by an air heat exchanger 742, which injects heated compressed air through a heated air input 744 by an air compressor 740 powered by geothermally generated electricity 408. The heated compressed air can be heated by the air heat exchanger 742 which can be heated by heat transfer fluid 404*c*. In FIG. 7, the air heat exchanger 742 is depicted as being arranged to heat the air as it is directed from the air compressor 740 to the heated air input 744. Heated air then heats the inside of the smelting furnace 736 which can then heat the copper sulfide 734. In other embodiments the air heat exchanger 742 can be disposed within the smelting furnace 736. Additionally, in FIG. 7 a heat exchanger 716 is depicted as being arranged to heat the walls of the smelting furnace 736 which can then heat the copper sulfide 734, but in other embodiments the heat exchanger 716 can be disposed within the smelting furnace 736. Examples of the heat exchanger 716 include shell-and-tube or tube-in-tube type heat exchangers.

Smelting melts the copper sulfide 734 into a molten liquid which then settles to the bottom of the smelting furnace 736 or is poured into a slag-settling furnace. During smelting, iron sulfides are reacted with oxygen (present in the injected air) to generate iron oxides. Copper sulfide and iron oxide can combine, but when smelting reagents 738 (e.g., silica) are added a distinct layer of slag 746 forms. An example reaction is $2CuFeS_2+2SiO_2+4O_2 \rightarrow Cu_2S+2FeSiO_3+3SO_2$. Similar reactions may occur with other metal oxides present as impurities (e.g., lead, cadmium). Copper matte 750, a mixture of copper, sulfur and iron, is the product. The copper matte 750 settles as a molten layer at the bottom of the smelting furnace 736 where it can be transferred through a matte tap 752 to be further processed by the converter 758. A molten layer of slag 746, a dense glassy material made of iron, silica, and other impurities, also settles at the bottom of the smelting furnace 736. The two molten layers are separate due to density differences. The slag 746 is transferred through a slag tap 748 to be further processed as waste. A portion of volatile pollutants such as sulfur are oxidized and carried away as exhaust output 754 driven out by an exhaust system 756 powered by electricity 408 generated by heat in the geothermal system.

The copper matte 750 is heated in the converter 758 to burn off any remaining iron and sulfur to convert it to a blister copper 762. The converter 758 is any vessel that can be heated and can receive and handle the copper matte 750. The temperature of the converter 758 is maintained at an elevated temperature (e.g., 2300° C.). Heat can be provided at least in part by an air heat exchanger 742, which injects heated compressed air through a heated air input 744 by an air compressor 740 powered by geothermally generated electricity 408. The heated compressed air can be heated by the air heat exchanger 742 which can be heated by heat transfer fluid 404*c*. In FIG. 7, the air heat exchanger 742 is depicted as being arranged to heat the air as it is directed from the air compressor 740 to the heated air input 744. Heated air then heats the inside of the smelting furnace 736 which can then heat the copper sulfide 734. In other embodiments the air heat exchanger 742 can be disposed within the smelting furnace 736. Additionally, in FIG. 7 a heat exchanger 716 is depicted as being arranged to heat the walls of the smelting furnace 736 which can then heat the copper sulfide 734, but in other embodiments the heat exchanger 716 can be disposed within the smelting furnace 736. Examples of the heat exchanger 716 include shell-and-tube or tube-in-tube type heat exchangers.

During converting of copper matte 750 to blister copper 762 in the converter 758, copper sulfide is reacted with oxygen (present in the injected air) to extract copper. Oxygen is supplied to the converter 758 by air injectors 760 which are arranged in a way to cover a substantial area of the molten copper matte 750. An example reaction is $Cu_2S+O_2 \rightarrow 2Cu+SO_2$. Blister copper 762 is a product of this process. Slag 746 is transferred out of a slag tap 748 to be further processed as waste. The blister copper 762 is transferred to an anode smelter 764 to burn off oxygen to produce a molten anode copper which can then be poured into molds. The molten anode copper is allowed to cool. The copper anode 766 is up to 99% copper and is the product.

Electrolysis is performed to obtain pure copper from the copper sulfide in the copper anode 766. The copper anode 766 is installed in an electrolytic smelter 768 submerged in a smelting bath 772 (e.g., copper sulfate and sulfuric acid solution which acts as an electrolyte). Electrolytic reduction is driven by a current between a cathode 770 which lines the smelting bath 772 and the copper anode 766. Example materials that may be used for the cathode 770 are thin sheets of copper installed between the anodes. The electric current passes through the smelting bath 772, from the cathode 770 to the anode 766, causing copper to be plated on the cathode 770 as copper coating 774. The copper coating 774 is up to 99.99% pure and is removed from the cathode 770 periodically. Electrolytic reduction may be maintained at an optimal temperature range (e.g., 40-60° C.) to improve copper collection efficiency. For example, the electrolytic smelter 768 may be heated or cooled accordingly, as needed, to maintain the temperature in the electrolytic smelter 768 at a target temperature or within a target temperature range. Temperature may be controlled using a temperature control system (see FIG. 10) positioned within or proximate to the electrolytic smelter 768.

Electrolysis requires a high energy demand. This disclosure provides a solution to this problem by facilitating the operation of the electrolytic smelter 768 using geothermal energy. For example, the current used for electrolysis may be supplied by electricity 408 derived from the conversion of heat in the heat transfer fluid 404*c* by turbines (e.g., turbines 904, 908 of FIG. 9). The smelting bath 772 is heated up to 2300° C. by a heat transfer fluid 404*c* to help improve electrolytic efficiency. This heating using heat from a geothermal well reduces cost and inefficiencies associated with conventional energy strategies such as fossil fuels.

Similarly to as described above for system 500, the copper coating 774 may be melted in a foundry 776 to produce molten copper 778. The foundry 776 can be any vessel capable of receiving and containing the molten copper 778, cooling the molten copper 778, and forming it into masses of various shapes and sizes. The final copper product 784 may be cast into any desired shape, for example, ingots, wires, and tubing.

Example Method of Geothermally Powered Pyrometallurgical Copper Production

Figure 8:
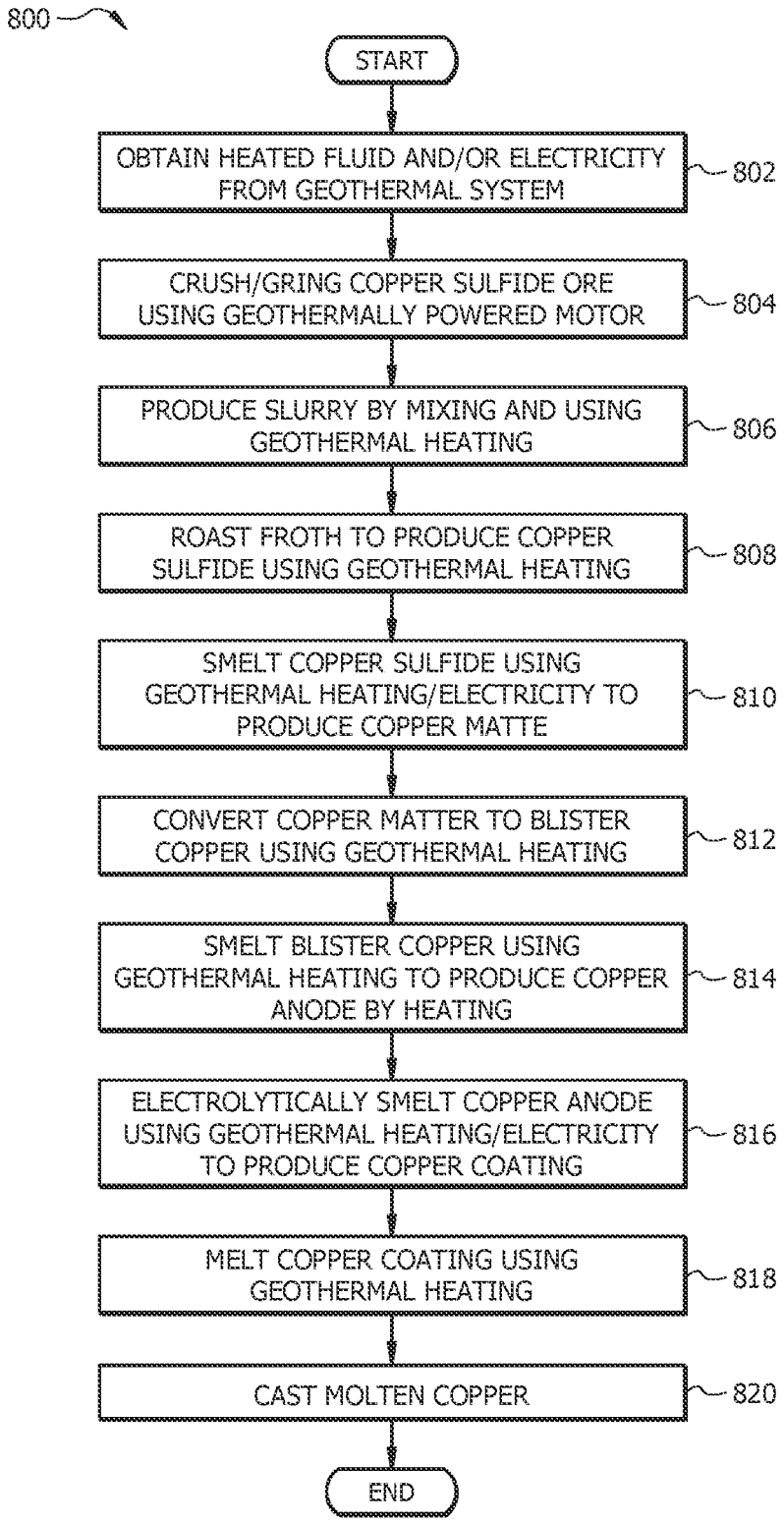
FIG. 8 is a flowchart of an example method for operating the pyrometallurgical system of FIG. 4.

FIG. 8 shows an example method 800 of operating the geothermally powered pyrometallurgical copper production system 700 in FIG. 7. The method 800 may begin at 802. At step 802, the heated heat transfer fluid 404*c* and/or electricity 408 are received from the geothermal system, as described above with respect to FIGS. 1-4. At step 804, copper sulfide ore 704*a* is crushed and/or ground using a geothermally powered motor 702 to produce a ground copper sulfide 704*b*. At step 806, a slurry 714 is produced by combining and mixing the crushed and/or ground copper sulfide 704*b* with flotation reagents 712 and air from an air intake 720 and heating with the heat transfer fluid 404*c* to produce a froth 726 containing copper particles 728 in the slurry 714. At step 808, the froth 726 is roasted with the heat transfer fluid 404*c* to cause at least a portion of the copper particles 728 to become copper sulfide 734. At step 810, the copper sulfide 734 is smelted in a smelting furnace 736 by combining and mixing with smelting reagents 738 and heated air from a heated air input 744 heated with the heat transfer fluid 404*c* to produce a copper matte 750. At step 812, the copper matte 750 is converted in a converter 758 using heated air from an air injector 760 heated with the heat transfer fluid 404*c* to produce a blister copper 762. At step 814, the blister copper 762 is melted and cast into a copper anode 766 in the anode smelter 764. At step 816, an electrolytic smelter 768 reduces the copper anode 766 causing a copper coating 774 to deposit onto a cathode 770. Step 816 may be driven by current between the anode 766 and the cathode 770 described in FIG. 7, the current being generated by electricity 408 from the geothermally powered turbines 904, 908 configured to use the heat transfer fluid 404*c* heated by the geothermal system. At step 818, the copper coating is heated by the heat transfer fluid 404*c* to produce molten copper. At step 820, the molten copper is cast in a foundry.

Modifications, omissions, or additions may be made to method 800 depicted in FIG. 8. Method 800 may include more, fewer, or other steps. For example, at least certain steps may be performed in parallel or in any suitable order. While at times discussed as geothermally powered pyrometallurgical copper production system 700 performing steps, any suitable component of the geothermally powered pyrometallurgical copper production system 700 or other components of a geothermal system may perform or may be used to perform one or more steps of the method 800.

Example Thermal Process System

Figure 9:
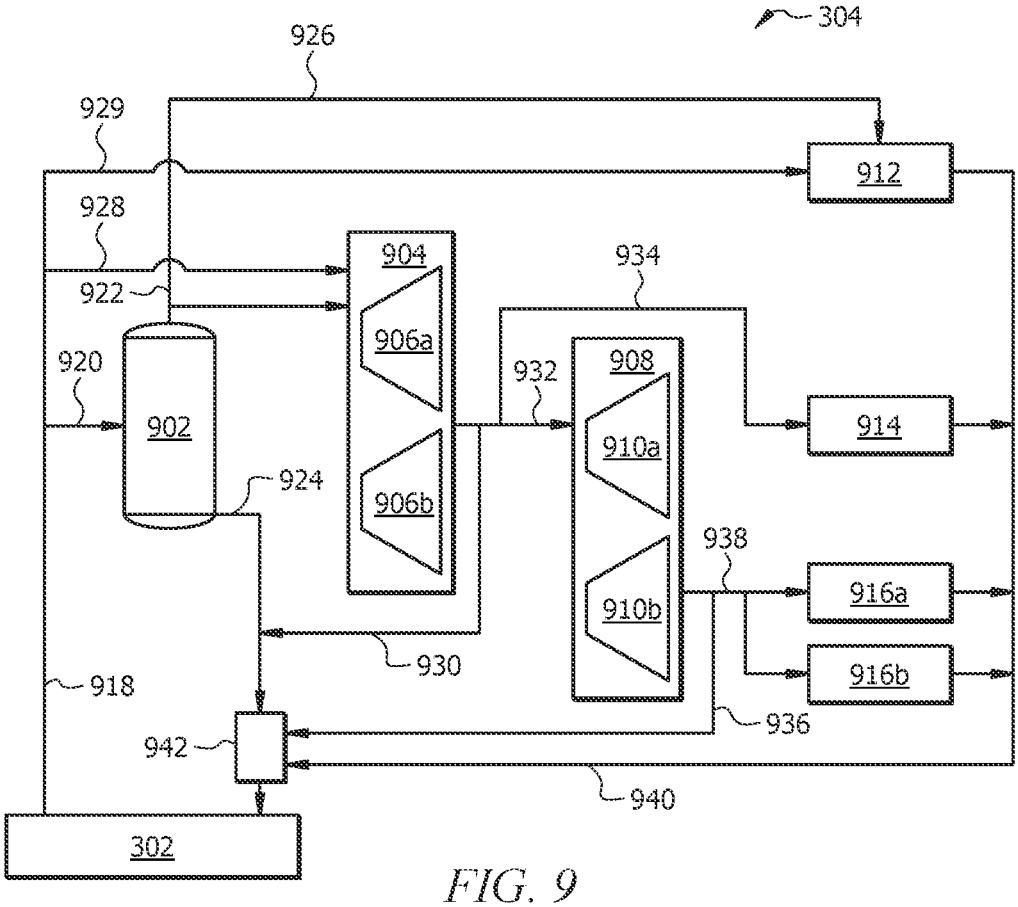
FIG. 9 is a diagram of an example system for performing thermal processes of FIGS. 3 and 4.

FIG. 9 shows a schematic diagram of an example thermal process system 304 of FIGS. 3 and 4. The thermal process system 304 includes a steam separator 902, a first turbine set 904, a second turbine set 908, a high-temperature/pressure thermochemical process 912, a medium-temperature/pressure thermochemical process 914, and one or more lower temperature/pressure processes 916*a,b*. The thermal process system 304 may include more or fewer components than are shown in the example of FIG. 9. For example, a thermal process system 304 used for power generation alone may omit the high-temperature/pressure thermochemical process 912, medium-temperature/pressure thermochemical process 914, and lower temperature/pressure processes 916*a,b*. Similarly, a thermal process system 304 that is not used for power generation may omit the turbine sets 904, 908. As a further example, if heat transfer fluid is known to be received only in the gas phase, the steam separator 902 may be omitted in some cases. The ability to tune the properties of the heat transfer fluid received from the unique wellbore 302 of FIGS. 3 and 4 facilitates improved and more flexible operation of the thermal process system 304. For example, the depth of the wellbore 302, the residence time of heat transfer fluid in the magma reservoir 214, the pressure achieved in the wellbore 302, and the like can be selected or adjusted to provide desired heat transfer fluid properties at the thermal process system 304.

In the example of FIG. 9, the steam separator 902 is connected to the wellbore 302 that extends between a surface and the underground magma reservoir. The steam separator 902 separates a vapor-phase heat transfer fluid (e.g., steam) from liquid-phase heat transfer fluid (e.g., condensate formed from the vapor-phase heat transfer fluid). A stream 920 received from the wellbore 302 may be provided to the steam separator 902. In some cases, all of stream 918 is provided in stream 920. In other cases, a fraction or none of stream 918 is provided to the steam separator 902. Instead, all or a portion of the stream 918 may be provided as stream 928 which may be provided to the first turbine set 904 and/or to a high-pressure thermal process 912 in stream 929. The thermal process 912 may be a thermochemical reaction requiring high temperatures and/or pressures (e.g., temperatures of between 500° F. and 2,000° F. and/or pressures of between 1,000 psig and 4,500 psig), such as the geothermally powered hydrogen production system 500. One or more valves (not shown for conciseness) may be used to control the direction of stream 920 to the steam separator 902, first turbine set 904, and/or thermal process 912. A vapor-phase stream 922 of heat transfer fluid from the condenser may be sent to the first turbine set 904 and/or the thermal process 912 via stream 926. A liquid-phase stream 924 of heat transfer fluid from the steam separator 902 may be provided back to the wellbore 302 and/or to condenser 742. The condenser 942 is any appropriate type of condenser capable of condensing a vapor-phase fluid. The condenser 942 may be coupled to a cooling or refrigeration unit, such as a cooling tower (not shown for conciseness).

The first turbine set 904 includes one or more turbines 906*a,b*. In the example of FIG. 9, the first turbine set includes two turbines 906*a,b*. However, the first turbine set 904 can include any appropriate number of turbines for a given need. The turbines 906*a,b* may be any known or yet to be developed turbine for electricity generation. The first turbine set 904 is connected to the steam separator 902 and is configured to generate electricity from the vapor-phase heat transfer fluid (e.g., steam) received from the steam separator 902 (vapor-phase stream 922). A stream 930 exits the first turbine set 904. The stream 930 may be provided to the condenser 942 and then back to the wellbore 302. The condenser 942 may be cooled using a heat driven chiller, such as an absorption chiller 1012 of FIG. 10, described below.

If the heat transfer fluid is at a sufficiently high temperature, as may be uniquely and more efficiently possible using the wellbore 302, a stream 1032 of vapor-phase heat transfer fluid may exit the first turbine set 904. Stream 932 may be provided to a second turbine set 908 to generate additional electricity. The turbines 910*a,b* of the second turbine set 908 may be the same as or similar to turbines 906*a,b*, described above.

All or a portion of stream 932 may be sent as vapor-phase stream 934 to a thermal process 914. Process 914 is generally a process requiring vapor-phase heat transfer fluid at or near the conditions of the heat transfer fluid exiting the first turbine set 904. For example, the thermal process 914 may include one or more thermochemical processes requiring steam or another heat transfer fluid at or near the temperature and pressure of stream 932 (e.g., temperatures of between 250° F. and 1,500° F. and/or pressures of between 500 psig and 2,000 psig). The second turbine set 908 may be referred to as "low pressure turbines" because they operate at a lower pressure than the first turbine set 904. Fluid from the second turbine set 908 is provided to the condenser 942 via stream 936 to be condensed and then sent back to the wellbore 302 via stream 936.

An effluent stream 938 from the second turbine set 908 may be provided to one or more thermal processes 916*a,b*. Thermal processes 916*a,b* generally require less thermal energy than thermal processes 912 and 914, described above (e.g., processes 916*a,b* may be performed temperatures of between 220° F. and 700° F. and/or pressures of between 15 psig and 120 psig). As an example, processes 916*a,b* may include water distillation processes, heat-driven chilling processes, space heating processes, agriculture processes, aquaculture processes, and/or the like. For instance, an example heat-driven chiller process 916*a* may be implemented using one or more heat driven chillers. Heat driven chillers can be implemented, for example, in data centers, crypto-currency mining facilities, or other locations in which undesirable amounts of heat are generated. Heat driven chillers, also conventionally referred to as absorption cooling systems, use heat to create chilled water. Heat driven chillers can be designed as direct-fired, indirect-fired, and heat-recovery units. When the effluent includes low pressure steam, indirect-fired units may be preferred. An effluent stream 940 from all processes 912, 914, 916*a,b*, may be provided back to the wellbore 302.

Example Temperature Control System

Figure 10:
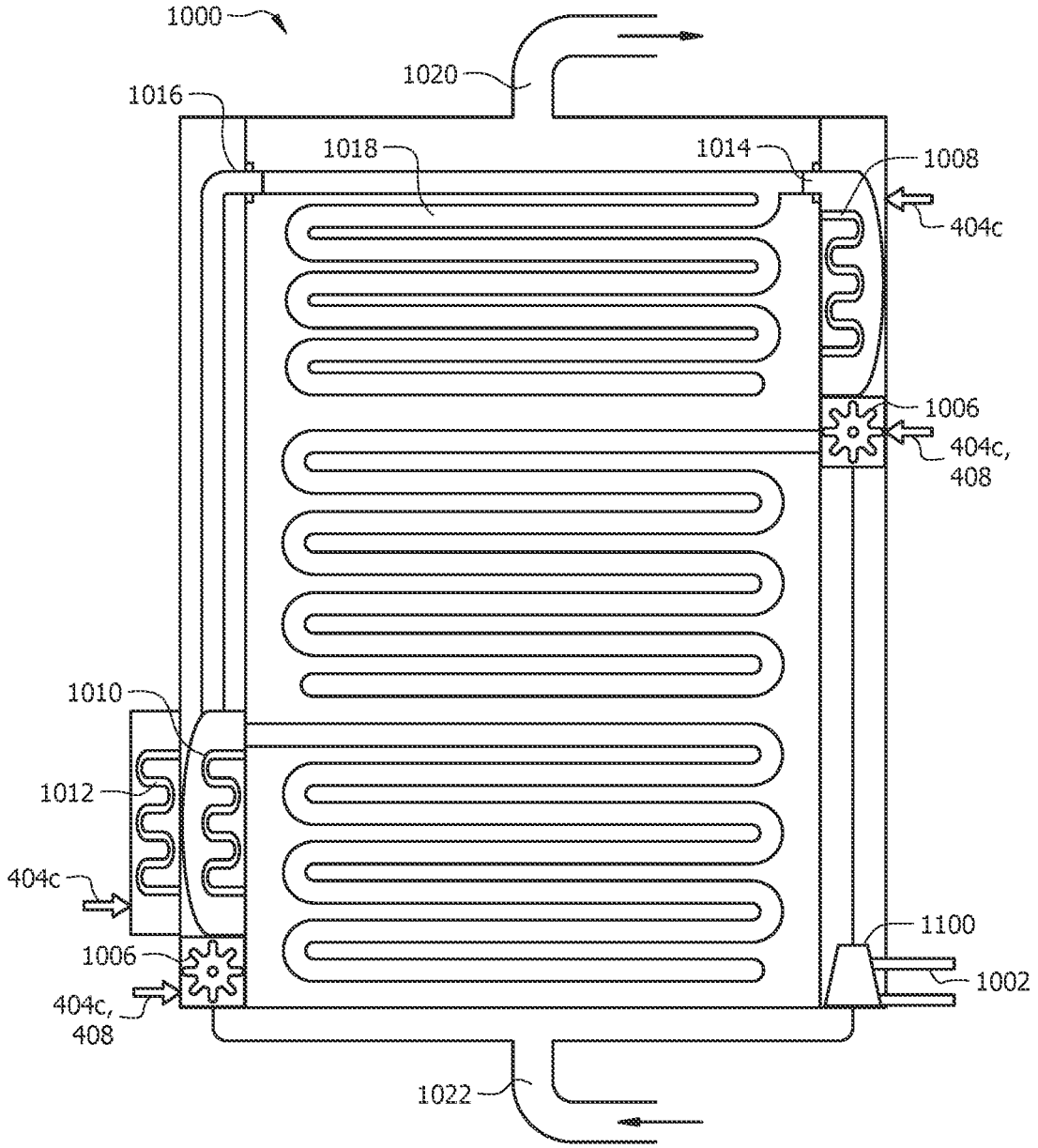
FIG. 10 is a diagram of an example system for heating and cooling components of the systems of FIG. 5 and FIG. 7 using heat transfer fluids and geothermal heating.

FIG. 10 shows an example temperature control system 1000 of FIGS. 5 and 7. The temperature control system 1000 is used to measure temperatures of system components (e.g., the electrolytic smelter 532) components and coordinate heating and cooling elements to maintain the desired temperatures. The temperature control system 1000 includes temperature sensors 1002, a temperature controller 1100, geothermally powered motors 1006, a heat exchanger 1008, a recirculating cooler 1010, an absorption chiller 1012, and a thermal fluid system 1018. The temperature control system 1000 may include more or fewer components than are shown in the example of FIG. 10. For example, a temperature control system 1000 used for heating alone may omit the recirculating cooler 1010 and the absorption chiller 1012. Similarly, a temperature control system 1000 that is used for cooling alone may omit the heat exchanger 1008. The ability to independently adjust the functions of heating and cooling by use of the temperature control system 1000 facilitates improved and more flexible response to fluctuating temperatures measured in system components. For example, a smelting process may necessitate a vessel to be maintained within an operational temperature range (i.e., a minimum temperature to drive an electrochemical reaction and a maximum temperature to curtail formation of byproducts). The temperature setpoint for such a vessel can be selected or adjusted to provide desired optimal temperatures.

In the example of FIG. 10, the temperature of a system component (e.g., an electrolytic smelter) is measured by the temperature sensors 1002. Example temperature sensors are thermostats, thermistors, resistive temperature detectors, thermocouples, and semiconductor-based sensors. If the temperature measurement exceeds a heating setpoint, the temperature controller 1100 (see FIG. 11 and corresponding descriptions below) switches the heat exchanger 1008 off. As an example, a pump relay switch may be used in conjunction with the fluid pumps 1114 to control flow of heat transfer fluid from the heat exchanger 1008 through a heated fluid input 1014 or the recirculating cooler 1010 and the absorption chiller 1012 through a cooled fluid input 1016 to heat or cool the thermal fluid system 1018, respectively. If the temperature measurement exceeds a maximum threshold, the heat exchanger 1008 is shut off and the temperature controller 1100 switches the recirculating cooler 1010 on to begin cooling the thermal fluid system 1018. If the temperature measurement exceeds a cooling setpoint, the temperature controller 1100 switches the recirculating cooler 1010 off. If the temperature measurement exceeds a minimum threshold, the recirculating cooler 1010 is shut off and the heat exchanger 1008 is turned on to begin heating the thermal fluid system 1018. The heat transfer fluid of the thermal fluid system 1018 is fed to the system component in need of heating or cooling via a thermal fluid output 1020 and is returned to the thermal fluid system 1018 via a thermal fluid input 1022.

The temperature control system 1000 can deliver high temperature thermal fluid via heat transfer fluids in contact with a magma chamber or in contact with heat transfer fluids heated by a magma chamber for operations that require heating. Heated heat transfer fluids can heat the thermal fluid in the thermal fluid system 1018 via heat exchange with the heat exchanger 1008. This ability to obtain high heat transfer allows deployment of alternative methods of heating during smelting and converting compared to conventional fossil fuels. Geothermal heating can extract copper from lower grade ores using less energy consumption and producing lower $CO_2$ emissions, resulting in reduced economic loss and environmental impacts.

The temperature control system 1000 can deliver low temperature thermal fluid via heat transfer fluids routed by a recirculating cooler 1010 and cooled by an absorption chiller 1012 for operations that require cooling. Cooled heat transfer fluids can cool the thermal fluid in the thermal fluid system 1018 via heat exchange with the recirculating cooler 1010. This ability to expedite the cooling process compared to passive cooling (i.e., allowing the system component to cool via turning off heating and waiting) can reduce waste generated as byproducts and hasten cooling to more quickly produce finished copper products leading to economic gains.

Figure 11:
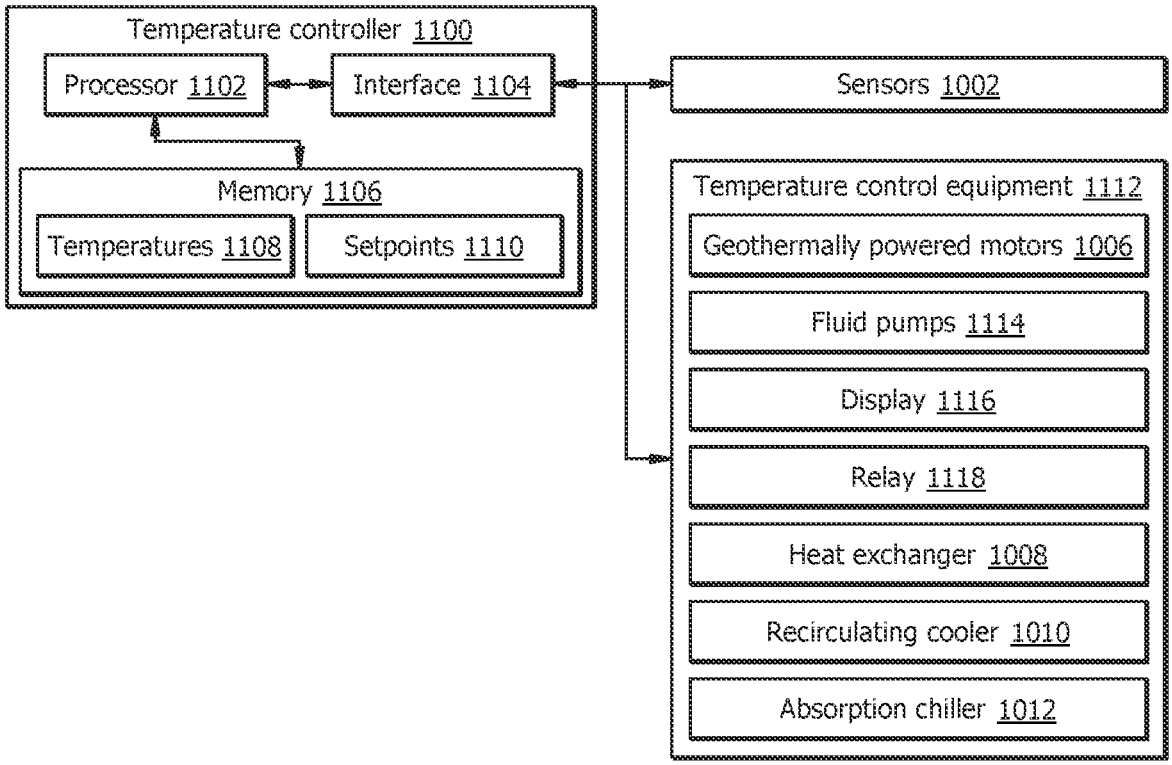
FIG. 11 is a diagram of an example temperature controller used to operate heating and cooling functions in FIG. 10.

FIG. 11 illustrates an example temperature controller 1100 in greater detail. The example temperature controller 1100 includes a processor 1102, interface 1104, and memory 1106. The processor 1102 is electronic circuitry that coordinates operations of the temperature controller 1100. The processor 1102 may be a programmable logic device, a microcontroller, a microprocessor, or any suitable combination of these or similar components. The processor 1102 is communicatively coupled to the memory 1106 and interface 1104. The processor 1102 may be one or more processors. The processor 1102 may be implemented using hardware and/or software.

The interface 1104 enables wired and/or wireless communications of data or other signals between the temperature controller 1100 and other devices, systems, or domain(s), such as the temperature sensors 1002 and other temperature control equipment 1112. The temperature control equipment 1112 may correspond to any components of temperature control system 1000 illustrated in FIG. 10 or otherwise understood by a skilled person to be employed in mineral extraction operations. For example, the temperature control equipment 1112 may include one or more geothermally powered motors 1006 (e.g., to power fluid pumps 1114), fluid pumps 1114, and a display 1116 (e.g., an electronic display capable of displaying information determined by the temperature controller 1100). The interface 1104 is an electronic circuit that is configured to enable communication between these devices. For example, the interface 1104 may include one or more serial ports (e.g., USB ports or the like) and/or parallel ports (e.g., any type of multi-pin port) for facilitating this communication. As a further example, the interface 1104 may include a wired or wireless network interface such as a Wi-Fi interface, a local area network (LAN) interface, a wide area network (WAN) interface, a modem, a switch, or a router. The processor 1102 may send and receive data using the interface 1104. For instance, the interface 1104 may send instructions to turn on the heat exchanger 1008 when a temperature measurement of a system component below the heating setpoint is detected. The interface 1104 may provide signals to cause a display 1116 to show an indication that a heating mode is being automatically implemented or should be implemented by an operator of a system component associated with the temperature controller 1100.

The memory 1106 stores any data, instructions, logic, rules, or code to execute the functions of the temperature controller 1100. For example, the memory 1106 may store monitored temperatures 1108, such as the temperature measured inside an electrolytic smelter 768, and setpoints 1110 that are compared to measured temperatures to determine operations. As described in more detail with respect to the various examples above, the monitored temperatures 1108 may be used to detect when the temperature of a system component has reached one of the setpoints 1110. For instance, if the monitored temperatures 1108 is detected by the temperature sensors 1002 as exceeding the range of the temperature in the setpoints 1110, the relay 1118 may be used to operate the heat exchanger 1008 or the recirculating cooler 1010. The memory 1106 may include one or more disks, tape drives, solid-state drives, and/or the like. The memory 1106 may store programs, instructions, and data that are read during program execution. The memory 1106 may be volatile or non-volatile and may comprise read-only memory (ROM), random-access memory (RAM), ternary content-addressable memory (TCAM), dynamic random-access memory (DRAM), and static random-access memory (SRAM).

Example Method of Operating Temperature Control System

Figure 12:
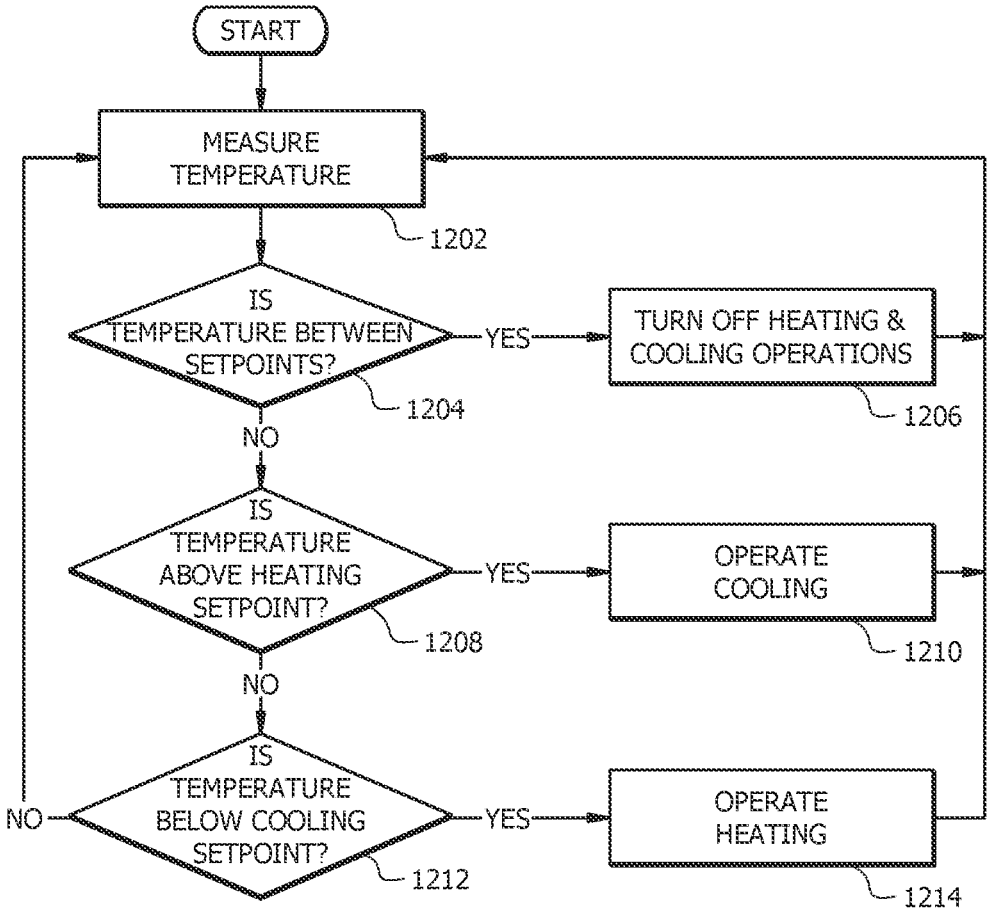
FIG. 12 is a flowchart of an example method for operating the example temperature controller of FIG. 11.

FIG. 12 illustrates an example method 1200 of operation of the temperature control system 1000. The method 1200 may begin at step 1202 where the temperature of a system component can be measured by use of the temperature sensors 1002. At step 1204, the temperature measured at step 1202 is stored as temperatures 1108 and compared to the setpoints 1110, as described above with respect to the example of FIG. 11. If the temperatures 1108 are determined to be within the range of temperatures in the setpoints 1110 (e.g., a cooling setpoint and a heating setpoint), operation proceeds to step 1206. At step 1206, all heating and cooling operations are turned off by using the relay 1118, then operations proceed to repeat step 1202 to measure the temperature of the system component by use of the temperature sensors 1002.

At step 1204, if the temperatures 1108 are determined to be outside the range of temperatures in the setpoints 1110, operation proceeds to step 1208. If the temperatures 1108 are determined to be exceeding the setpoints 1110 for heating, operation proceeds to step 1210. At step 1210, cooling operations (i.e., the recirculating cooler 1010 and the absorption chiller 1012) are turned on by using the relay 1118 or remain on, then operations proceed to repeat step 1202 to measure the temperature of the system component by use of the temperature sensors 1002.

At step 1208, if the temperatures 1108 are determined to not be exceeding the setpoints 1110 for heating, operation proceeds to step 1212. If the temperatures 1108 are determined to be exceeding the setpoints 1110 for cooling, operation proceeds to step 1214. At step 1214, cooling operations are turned off if they are on by the use of the relay 1118 and heating operations (i.e., the heat exchanger 1008) are turned on or remain on, then operations proceed to repeat step 1202 to measure the temperature of the system component by use of the temperature sensors 1002. If the temperatures 1108 are determined to not be exceeding the setpoints 1110 for cooling, operation returns to step 1202 to repeat temperature measurement.

Modifications, omissions, or additions may be made to method 1200 depicted in FIG. 12. Method 1200 may include more, fewer, or other steps. For example, at least certain steps may be performed in parallel or in any suitable order. All or a portion of the operations may be performed by or facilitated using information determined using the temperature control system of FIG. 10. Any suitable temperature control equipment 1004 or associated component(s) may perform or may be used to perform one or more steps of the method 1200.

While the example systems of this disclosure are described as employing heating through thermal contact with a magma reservoir 214, it should be understood that this disclosure also encompasses similar systems in which another thermal reservoir or heat source is harnessed. For example, heat transfer fluid may be heated by underground water at an elevated temperature. As another example, heat transfer fluid may be heated by radioactive material emitting thermal energy underground or at or near the surface. As yet another example, heat transfer fluid may be heated by lava, for example, in a lava lake or other formation. As such, the magma reservoir 214 may be any thermal reservoir or heat source that is capable of heating heat transfer fluid to achieve desired properties (e.g., of temperature and pressure). Furthermore, the thermal reservoir or heat source may be naturally occurring or artificially created (e.g., by introducing heat underground that can be harnessed at a later time for energy generation or other thermal processes).

The geothermally powered systems of this disclosure may reduce waste in several ways. In addition to the advantages of the alternative equipment and/or methods described above, waste may further be reduced by the ability to process waste byproducts of the copper production system into useful secondary raw materials. Waste byproducts of metal refining often sit idle and contribute to pollution of local environments. The storage, disposal, and recycling of these byproducts, such as electric arc furnace dust, slag, and refractories is costly. The efficient and clean supply of energy from geothermal resources can power the processing of such wastes. Additionally, waste can be reduced by reducing carbon emissions from the electrolysis conventionally used during smelting. This process requires large amounts of electrical power. An estimated power consumption of 2.8 kWh per kg of copper produced presents challenges to the industry in terms of energy availability and cost and provides profit and environmental motivation to utilizing geothermal energy as presented in this disclosure. As described in this disclosure, geothermal energy can power copper production systems to produce less waste and less pollution (e.g., without using coal-fired processes or with a significant decrease in the use of such processes). As such, this disclosure may facilitate copper production with a decreased environmental impact and decreased use of costly materials.

Although embodiments of the disclosure have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. Moreover, items shown or discussed as coupled or directly coupled or communicating with each other may be indirectly coupled or communicating through some interface device, or intermediate component whether electrically, mechanically, fluidically, or otherwise.

While this disclosure has been particularly shown and described with reference to preferred or example embodiments, it will be understood by those skilled in the art that various changes in form and detail may be made therein without departing from the spirit and scope of the disclosure. Accordingly, this disclosure includes all modifications and equivalents of the subject matter recited in the claims appended hereto as permitted by applicable law. Changes, substitutions and alterations are ascertainable by one skilled in the art and could be made without departing from the spirit and scope disclosed herein. Moreover, any combination of the above-described elements in all possible variations thereof is encompassed by the disclosure unless otherwise indicated herein or otherwise clearly contradicted by context.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

ADDITIONAL EMBODIMENTS

Embodiment 1. A geothermally powered hydrometallurgical copper production system, comprising:

a geothermal system comprising a wellbore extending from a surface into an underground magma reservoir, the wellbore configured to heat a heat transfer fluid via heat transfer with the underground magma reservoir, thereby forming heated heat transfer fluid;

a settler comprising a vessel configured to:

receive a leach solution; and heat the received leach solution via heat transfer with the heated heat transfer fluid, thereby producing a copper solution, wherein the copper solution comprises copper and one or more impurities;

an electrolytic smelter comprising a vessel configured to:

receive at least a portion of the copper solution produced by the settler;

maintain, using a temperature control system, temperature in a smelting bath within a predefined temperature range; and conduct electrical current through the received copper solution via electricity generated using the heated heat transfer fluid, thereby causing a copper coating to form; and a foundry comprising a vessel configured to:

receive at least a portion of the copper coating produced by the electrolytic smelter;

heat the received copper coating at least in part via heat transfer with the heated heat transfer fluid, thereby causing the copper coating to melt and become molten copper; and cast the molten copper to form a copper product, wherein the system optionally includes any one or more of the following elements:

a leaching system configured to process a copper oxide ore to extract the copper to produce the leach solution, the leaching system comprising:

a hopper comprising a vessel configured to receive the copper oxide ore and direct the received copper oxide ore through a crusher;

the crusher configured to crush at least a portion of the copper oxide ore directed therethrough, thereby forming a crushed copper oxide ore;

a sprinkler configured to apply leaching reagents onto the crushed copper oxide ore; and a leach heap comprising a collection area configured to:

receive at least a portion of the crushed copper oxide ore and the leaching reagents;

facilitate a chemical reaction between the received portion of the crushed copper oxide ore and the leaching reagents to produce the leach solution;

facilitate percolation of the leach solution through the crushed copper oxide ore in a gravity-driven flow; and collect the leach solution in a collection ditch;

wherein the settler further comprises:

one or more heat exchangers configured to heat the leach solution via heat transfer with the heated heat transfer fluid, thereby causing solvent extraction of copper ion from the leach solution;

a mixer configured to agitate the leach solution, thereby causing separation of the copper solution and a solvent; and an impurities reservoir positioned within or proximate to the settler and configured to receive at least a portion of the impurities produced in the settler;

wherein the electrolytic smelter further comprises:

one or more heat exchangers configured to heat the copper solution, if a temperature of the copper solution is less than a minimum temperature threshold, via heat transfer with the heated heat transfer fluid;

one or more circulating coolers configured to cool the copper solution, if the temperature of the copper solution exceeds a maximum temperature threshold, via heat transfer with a cooling fluid; and a cathode and an anode configured to conduct the electricity through the copper solution, thereby forming the copper coating;

one or more geothermally powered motors configured to use the heated heat transfer fluid to perform mechanical operations of the geothermally powered hydrometallurgical copper production system, wherein the one or more geothermally powered motors are configured to perform one or more of:

moving a copper oxide ore through a hopper;
rotating a crusher;
pumping leaching reagents through one or more sprinklers; and
rotating a mixer in the settler;
one or more heat exchangers configured to circulate the heated heat transfer fluid to perform operations of the geothermally powered hydrometallurgical copper production system, wherein the one or more heat exchangers are configured to perform one or more of:
heating the settler;
heating the electrolytic smelter; and
heating the foundry;
one or more turbines configured to use the heated heat transfer fluid to generate the electricity, wherein the generated electricity provides the electrical current between a cathode and an anode in the electrolytic smelter;
an absorption chiller configured to:
receive the heat transfer fluid heated by the geothermal system;
generate a cooling fluid using the received heat transfer fluid; and
provide the cooling fluid to one or more processes requiring cooling; and
a condenser configured to:
receive the cooling fluid; and
condense the heat transfer fluid via heat transfer with the received cooling fluid before the heat transfer fluid is returned to the wellbore of the geothermal system.

Embodiment 2. A method, comprising:
heating, using a geothermal system comprising a wellbore extending from a surface into an underground magma reservoir, a heat transfer fluid via heat transfer with the underground magma reservoir, thereby forming heated heat transfer fluid;
receiving, by a settler, a leach solution;
heating, by the settler, the received leach solution via heat transfer with the heated heat transfer fluid, thereby producing a copper solution and impurities;
receiving, by an electrolytic smelter, at least a portion of the copper solution produced by the settler;
maintaining, using a temperature control system, temperature in a smelting bath within a predefined temperature range;
conducting, by the electrolytic smelter, electrical current through the received copper solution via electricity generated using the heated heat transfer fluid, thereby causing a copper coating to form;
receiving, by a foundry, the copper coating produced by the electrolytic smelter;
heating, by the foundry, the received copper coating via heat transfer with the heated heat transfer fluid, thereby causing the copper coating to melt to become molten copper; and
casting, by the foundry, the molten copper to form a copper product, wherein the method optionally includes any one or more of the following elements:
wherein producing the leach solution further comprises:
directing, using a hopper, a copper oxide ore through a crusher;
crushing, using the crusher, at least a portion of the copper oxide ore directed therethrough, thereby forming crushed copper oxide ore;
receiving, by a leach heap, at least a portion of the crushed copper oxide ore;
distributing, by a sprinkler, leaching reagents onto the leach heap to cause a leaching reaction to extract copper from the crushed copper oxide ore;
producing, by the leaching reaction, the leach solution; and
collecting, by a collection ditch, the leach solution;
wherein producing, by the settler, the copper solution comprises:
heating, by one or more heat exchangers, the leach solution via heat transfer with the heated heat transfer fluid, thereby causing solvent extraction of copper ions from the leach solution;
agitating, by a mixer, the leach solution, thereby causing separation of the copper solution and a solvent; and
directing at least a portion of the impurities produced in the settler to an impurities reservoir positioned within or proximate to the settler;
using one or more geothermally powered motors powered by the heated heat transfer fluid, wherein the one or more geothermally powered motors are configured to perform one or more of:
moving a copper oxide ore through a hopper;
rotating a crusher;
pumping leaching reagents through one or more sprinklers;
rotating a mixer in the settler;
pumping heated heat transfer fluids used to heat system components; and
pumping cooling fluids used to cool the system components;
causing one or more heat exchangers to use the heated heat transfer fluid to heat a fluid, thereby producing a heated fluid, wherein the heated fluid supplies heat for one or more of:
heating the settler;
heating the electrolytic smelter; and
heating the foundry;
wherein producing the copper coating comprises:
heating, by one or more heat exchangers positioned within or proximate to the electrolytic smelter, the copper solution, if a temperature of the copper solution is less than a minimum temperature threshold, via heat transfer with the heated heat transfer fluid;
cooling, by one or more circulating coolers positioned within or proximate to the electrolytic smelter, the copper solution, if the temperature of the copper solution exceeds a maximum temperature threshold, via heat transfer with a cooling fluid; and
conducting, by a cathode and an anode, the electricity in the copper solution, thereby forming the copper coating;
causing one or more turbines to use the heated heat transfer fluid to generate the electricity, wherein the generated electricity provides the electrical current between a cathode and an anode in the electrolytic smelter;
generating a cooling fluid:
receiving, by an absorption chiller, the heat transfer fluid heated by the geothermal system;
generating, by the absorption chiller, the cooling fluid using the received heat transfer fluid; and
providing the cooling fluid to one or more processes requiring cooling; and
receiving, by a condenser, the cooling fluid; and condensing, by the condenser, the heat transfer fluid via heat transfer with the received cooling fluid before the heat transfer fluid is returned to the wellbore of the geothermal system.

Embodiment 3. A geothermally powered pyrometallurgical copper production system comprising:

a geothermal system comprising a wellbore extending from a surface into an underground magma reservoir, the wellbore configured to heat a heat transfer fluid via heat transfer with the underground magma reservoir, thereby forming heated heat transfer fluid;

a flotation tank comprising a vessel configured to:

receive crushed copper sulfide ore;

receive flotation reagents;

suspend the received crushed copper sulfide ore and the received flotation reagents in a slurry; and heat the slurry via heat transfer with the heated heat transfer fluid, thereby forming a froth comprising copper particles;

a roaster comprising a vessel configured to:

receive at least a portion of the froth produced by the flotation tank; and heat the received froth via heat transfer with the heated heat transfer fluid, thereby causing the copper particles to be converted to copper sulfide;

a smelting furnace comprising a vessel configured to:

receive at least a portion of the copper sulfide produced in the roaster;

receive smelting reagents;

receive air; and heat the received copper sulfide, the received smelting reagents, and the received air at least in part using the heated heat transfer fluid, thereby facilitating reduction of the copper in the copper sulfide and removal of impurities to produce a copper matte and a slag;

a converter comprising a vessel configured to:

receive at least a portion of the copper matte produced by the smelting furnace;

receive air; and heat the received copper matte and the received air via heat transfer with the heated heat transfer fluid, thereby facilitating removal of impurities to produce a blister copper;

an anode smelter configured to:

receive at least a portion of the blister copper produced by the converter;

heat the received blister copper via heat transfer with the heated heat transfer fluid, thereby forming a molten blister copper; and transfer heat from the molten blister copper to a cooling fluid, thereby casting a copper anode;

an electrolytic smelter comprising a vessel configured to:

receive at least a portion of the copper anode produced by the anode smelter;

heat a smelting bath via heat transfer with the heated heat transfer fluid, thereby maintaining a temperature of the smelting bath within a range associated with electrolytic smelting; and conduct electrical current through the smelting bath using electricity generated using the heated heat transfer fluid, thereby causing a copper coating to form on a cathode; and a foundry comprising a vessel configured to:

receive at least a portion of the copper coating produced by the electrolytic smelter;

heat the received copper coating at least in part using the heated heat transfer fluid, thereby causing the copper coating to melt and become molten copper; and cast the molten copper to produce a copper product, wherein the system optionally includes any one or more of the following elements:

wherein the flotation tank comprises:

one or more heat exchangers configured to heat the slurry via heat transfer with the heated heat transfer fluid;

a mixer configured to agitate the slurry; and an air intake configured to inject the air into the slurry, thereby facilitating formation of the froth;

wherein the roaster comprises:

one or more heat exchangers positioned within or proximate to the roaster and configured to heat the froth via heat transfer with the heated heat transfer fluid; and one or more conveyors configured to transport the froth through the roaster;

wherein the smelting furnace comprises:

one or more heat exchangers positioned within or proximate to the smelting furnace and configured to heat the smelting furnace via heat transfer with the heated heat transfer fluid, thereby heating the copper sulfide to produce the copper matte and the slag;

one or more air heat exchangers configured to heat an air input via heat transfer with the heated heat transfer fluid, thereby generating heated air; and one or more air compressors positioned within or proximate to the smelting furnace and configured to direct the heated air to the copper sulfide to cause the copper sulfide to be converted to the copper matte;

wherein the converter comprises:

one or more heat exchangers positioned within or proximate to the converter and configured to heat the converter via heat transfer with the heated heat transfer fluid, thereby heating the copper matte produced by the smelting furnace to facilitate production of the blister copper and the slag;

one or more air heat exchangers configured to heat an air input via heat transfer with the heated heat transfer fluid, thereby heating the copper matte, thereby producing heated air; and one or more air compressors positioned within or proximate to the converter and configured to direct the heated air to the copper matte to cause the copper matte to be converted to the blister copper;

wherein the anode smelter further comprises:

one or more heat exchangers configured to heat the blister copper via heat transfer with the heated heat transfer fluid, thereby transforming the blister copper into the molten blister copper; and one or more circulating coolers configured to cool the molten blister copper via heat transfer with the cooling fluid, thereby transforming the molten blister copper into the copper anode;

wherein the electrolytic smelter further comprises:

one or more heat exchangers configured to heat the smelting bath, if a temperature of the smelting bath is less than a minimum threshold, via heat transfer with the heated heat transfer fluid;

one or more circulating coolers configured to cool the smelting bath, if the temperature of the smelting bath exceeds a maximum threshold, via heat transfer with the cooling fluid; and the cathode and an anode configured to conduct the electricity through the smelting bath, thereby forming the copper coating;

one or more geothermally powered motors configured to use the heated heat transfer fluid to perform mechanical operations of the geothermally powered pyrometallurgical copper production system, wherein the one or more geothermally powered motors are configured to perform one or more of:

moving the copper sulfide ore through a hopper;

rotating a crusher;

rotating a mixer in the flotation tank;

driving a conveyor to move the copper sulfide through the roaster;

powering air compressors for providing the air to the smelting furnace and/or the converter;

powering exhaust systems to remove gaseous byproducts;

pumping heated heat transfer fluid used to heat vessels and system components; and pumping cooling fluids used to cool system components;

one or more heat exchangers configured to circulate the heated heat transfer fluid to perform operations of the geothermally powered pyrometallurgical copper production system, wherein the one or more heat exchangers are configured to perform one or more of:

heating the flotation tank;

heating the roaster;

heating the smelting furnace;

heating the converter;

heating the electrolytic smelter;

heating the anode smelter; and heating the foundry;

one or more air heat exchangers configured to circulate the heated heat transfer fluid, wherein the one or more air heat exchangers are configured to heat one or more air inputs;

one or more turbines configured to use the heated heat transfer fluid to generate the electricity, wherein the generated electricity provides the electrical current between the cathode and an anode in the electrolytic smelter;

an absorption chiller configured to:

receive the heat transfer fluid heated by the geothermal system;

generate the cooling fluid using the received heat transfer fluid; and provide the cooling fluid to one or more processes requiring cooling; and a condenser configured to:

receive the cooling fluid; and condense the heat transfer fluid via heat transfer with the received cooling fluid before the heat transfer fluid is returned to the wellbore of the geothermal system.

Embodiment 4. A method, comprising:

heating, using a geothermal system comprising a wellbore extending from a surface into an underground magma reservoir, a heat transfer fluid via heat transfer with the underground magma reservoir, thereby forming heated heat transfer fluid;

receiving, by a flotation tank, crushed copper sulfide ore and flotation reagents;

suspending the received crushed copper sulfide ore and the received flotation reagents in a slurry held in the flotation tank;

heating the slurry in the flotation tank via heat transfer with the heated heat transfer fluid, thereby forming a froth comprising copper particles;

receiving, by a roaster, at least a portion of the froth produced by the flotation tank;

heating, in the roaster, the received froth via heat transfer with the heated heat transfer fluid, thereby causing the copper particles to be converted to a copper sulfide;

receiving, by a smelting furnace, at least a portion of the copper sulfide produced in the roaster;

receiving, by the smelting furnace, smelting reagents and air;

heating, by the smelting furnace, the received copper sulfide, the received smelting reagents, and the received air at least in part using the heated heat transfer fluid, thereby facilitating reduction of the copper in the copper sulfide and removal of impurities to produce a copper matte and a slag;

receiving, by a converter, at least a portion of the copper matte produced by the smelting furnace;

receiving, by the converter, air;

heating the received copper matte and the received air via heat transfer with the heated heat transfer fluid, thereby facilitating removal of impurities to produce a blister copper;

receiving, by an anode smelter, at least a portion of the blister copper produced by the converter;

transferring heat from the heated heat transfer fluid to the received blister copper, thereby producing a molten blister copper;

receiving, by the anode smelter, a cooling fluid;

transferring heat from the molten blister copper to the cooling fluid, thereby casting a copper anode;

receiving, by an electrolytic smelter, at least a portion of the copper anode produced by the anode smelter;

transferring heat from the heated heat transfer fluid to a smelting bath, thereby maintaining a temperature of the smelting bath within a range associated with electrolytic reduction of copper;

conducting electrical current through the smelting bath using electricity generated using the heated heat transfer fluid, thereby causing a copper coating to form;

receiving, by a foundry, at least a portion of the copper coating produced by the electrolytic smelter;

heating, by the foundry, the received copper coating at least in part using the heated heat transfer fluid, thereby causing the copper coating to melt and become molten copper; and casting, by the foundry, the molten copper to produce a copper product, wherein the method optionally includes any one or more of the following elements:

wherein producing the froth comprises:

heating, by one or more heat exchangers coupled to the flotation tank, the slurry via heat transfer with the heated heat transfer fluid;

agitating, by a mixer, the slurry;

injecting, by an air intake, the air into the slurry, thereby facilitating formation of the froth; and directing at least a portion of a byproduct to a waste collection reservoir;

wherein producing the copper sulfide comprises:

heating, by one or more heat exchangers positioned within or proximate to the roaster, the froth received from the flotation tank via heat transfer with the heated heat transfer fluid; and transporting, by one or more conveyors, the froth through the roaster;

wherein producing the copper matte comprises:

heating, by one or more heat exchangers positioned within or proximate to the smelting furnace, the smelting furnace via heat transfer with the heated heat transfer fluid, thereby heating the copper sulfide to produce the copper matte and the slag; and heating, by one or more air heat exchangers, an air input via heat transfer with the heated heat transfer fluid, thereby generating heated air;

wherein producing the blister copper comprises:

heating, by one or more heat exchangers positioned within or proximate to the converter, the converter via heat transfer with the heated heat transfer fluid, thereby heating the copper matte produced by the smelting furnace to facilitate production of the blister copper and the slag;

heating, by one or more air heat exchangers, an air input via heat transfer with the heated heat transfer fluid, thereby heating the copper matte produced by the smelting furnace, thereby producing heated air; and directing, by one or more air compressors positioned within or proximate to the converter, the heated air to the copper matte to cause the copper matte to convert to the blister copper;

wherein producing the copper anode comprises:

heating, by one or more heat exchangers positioned within or proximate to the anode smelter, the anode smelter via heat transfer with the heated heat transfer fluid, thereby heating the blister copper, thereby transforming the blister copper into the molten blister copper; and cooling, by one or more circulating coolers positioned within or proximate to the anode smelter, the anode smelter via heat transfer with the cooling fluid, thereby cooling the molten blister copper to produce the copper anode;

wherein producing the copper coating comprises:

if a temperature of the smelting bath is less than a minimum threshold, heating, by one or more heat exchangers positioned within or proximate to the electrolytic smelter, the smelting bath via heat transfer with the heated heat transfer fluid;

if a temperature of the smelting bath exceeds a minimum threshold, cooling, by one or more recirculating coolers positioned within or proximate to the electrolytic smelter, the smelting bath, via heat transfer with the cooling fluid; and conducting the electricity, by a cathode and an anode, through the smelting bath, thereby forming the copper coating;

using one or more geothermally powered motors powered by the heated heat transfer fluid, wherein the one or more geothermally powered motors are configured to perform one or more of:

moving the copper sulfide ore through a hopper;

rotating a crusher;

rotating a mixer in the flotation tank;

driving a conveyor to move the copper sulfide through the roaster;

powering air compressors for providing the air to the smelting furnace and/or the converter;

powering exhaust systems to remove gaseous byproducts;

pumping heated heat transfer fluid used to heat vessels and system components; and pumping cooling fluids used to cool system components;

causing one or more heat exchangers to use the heated heat transfer fluid to heat a fluid wherein the heated fluid supplies heat for one or more of:

heating the flotation tank;

heating the roaster;

heating the smelting furnace;

heating the converter;

heating the electrolytic smelter;

heating the anode smelter; and heating the foundry;

causing one or more air heat exchangers to use the heated heat transfer fluid to heat a fluid wherein the heated fluid supplies heat to one or more air inputs;

causing one or more turbines to use the heated heat transfer fluid to generate the electricity, wherein the generated electricity provides the electrical current between a cathode and an anode in the electrolytic smelter;

receiving, by an absorption chiller, the heat transfer fluid heated by the geothermal system;

generating, by the absorption chiller, the cooling fluid using the received heat transfer fluid; and providing the cooling fluid to one or more processes requiring cooling; and receiving, by a condenser, the cooling fluid; and condensing, by the condenser, the heat transfer fluid via heat transfer with the received cooling fluid before the heat transfer fluid is returned to the wellbore of the geothermal system.

While this disclosure has been particularly shown and described with reference to preferred or example embodiments, it will be understood by those skilled in the art that various changes in form and detail may be made therein without departing from the spirit and scope of the disclosure. Accordingly, this disclosure includes all modifications and equivalents of the subject matter recited in the claims appended hereto as permitted by applicable law. Changes, substitutions and alterations are ascertainable by one skilled in the art and could be made without departing from the spirit and scope disclosed herein. Moreover, any combination of the above-described elements in all possible variations thereof is encompassed by the disclosure unless otherwise indicated herein or otherwise clearly contradicted by context.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

What is claimed is:

1. A geothermally powered pyrometallurgical copper production system comprising:

a geothermal system comprising a wellbore extending from a surface into an underground magma reservoir, the wellbore configured to heat a heat transfer fluid via heat transfer with the underground magma reservoir, thereby forming heated heat transfer fluid;

a flotation tank comprising a vessel configured to:

receive crushed copper sulfide ore;

receive flotation reagents;

suspend the received crushed copper sulfide ore and the received flotation reagents in a slurry; and heat the slurry via heat transfer with the heated heat transfer fluid, thereby forming a froth comprising copper particles;

a roaster comprising a vessel configured to:

receive at least a portion of the froth produced by the flotation tank; and heat the received froth via heat transfer with the heated heat transfer fluid, thereby causing the copper particles to be converted to copper sulfide;

a smelting furnace comprising a vessel configured to:

receive at least a portion of the copper sulfide produced in the roaster;

receive smelting reagents;

receive air; and heat the received copper sulfide, the received smelting reagents, and the received air at least in part using the heated heat transfer fluid, thereby facilitating reduction of the copper in the copper sulfide and removal of impurities to produce a copper matte and a slag;

a converter comprising a vessel configured to:

receive at least a portion of the copper matte produced by the smelting furnace;

receive air; and heat the received copper matte and the received air via heat transfer with the heated heat transfer fluid, thereby facilitating removal of impurities to produce a blister copper;

an anode smelter configured to:

receive at least a portion of the blister copper produced by the converter;

heat the received blister copper via heat transfer with the heated heat transfer fluid, thereby forming a molten blister copper; and transfer heat from the molten blister copper to a cooling fluid, thereby casting a copper anode;

an electrolytic smelter comprising a vessel configured to:

receive at least a portion of the copper anode produced by the anode smelter;

heat a smelting bath via heat transfer with the heated heat transfer fluid, thereby maintaining a temperature of the smelting bath within a range associated with electrolytic smelting; and conduct electrical current through the smelting bath using electricity generated using the heated heat transfer fluid, thereby causing a copper coating to form on a cathode; and a foundry comprising a vessel configured to:

receive at least a portion of the copper coating produced by the electrolytic smelter;

heat the received copper coating at least in part using the heated heat transfer fluid, thereby causing the copper coating to melt and become molten copper; and cast the molten copper to produce a copper product.

2. The geothermally powered pyrometallurgical copper production system of claim 1, wherein the flotation tank comprises:

one or more heat exchangers configured to heat the slurry via heat transfer with the heated heat transfer fluid;

a mixer configured to agitate the slurry; and an air intake configured to inject the air into the slurry, thereby facilitating formation of the froth.

3. The geothermally powered pyrometallurgical copper production system of claim 1, wherein the roaster comprises:

one or more heat exchangers positioned within or proximate to the roaster and configured to heat the froth via heat transfer with the heated heat transfer fluid; and one or more conveyors configured to transport the froth through the roaster.

4. The geothermally powered pyrometallurgical copper production system of claim 1, wherein the smelting furnace comprises:

one or more heat exchangers positioned within or proximate to the smelting furnace and configured to heat the smelting furnace via heat transfer with the heated heat transfer fluid, thereby heating the copper sulfide to produce the copper matte and the slag;

one or more air heat exchangers configured to heat an air input via heat transfer with the heated heat transfer fluid, thereby generating heated air; and one or more air compressors positioned within or proximate to the smelting furnace and configured to direct the heated air to the copper sulfide to cause the copper sulfide to be converted to the copper matte.

5. The geothermally powered pyrometallurgical copper production system of claim 1, wherein the converter comprises:

one or more heat exchangers positioned within or proximate to the converter and configured to heat the converter via heat transfer with the heated heat transfer fluid, thereby heating the copper matte produced by the smelting furnace to facilitate production of the blister copper and the slag;

one or more air heat exchangers configured to heat an air input via heat transfer with the heated heat transfer fluid, thereby heating the copper matte, thereby producing heated air; and one or more air compressors positioned within or proximate to the converter and configured to direct the heated air to the copper matte to cause the copper matte to be converted to the blister copper.

6. The geothermally powered pyrometallurgical copper production system of claim 1, wherein the anode smelter further comprises:

one or more heat exchangers configured to heat the blister copper via heat transfer with the heated heat transfer fluid, thereby transforming the blister copper into the molten blister copper; and one or more circulating coolers configured to cool the molten blister copper via heat transfer with the cooling fluid, thereby transforming the molten blister copper into the copper anode.

7. The geothermally powered pyrometallurgical copper production system of claim 1, wherein the electrolytic smelter further comprises:

one or more heat exchangers configured to heat the smelting bath, if a temperature of the smelting bath is less than a minimum threshold, via heat transfer with the heated heat transfer fluid;

one or more circulating coolers configured to cool the smelting bath, if the temperature of the smelting bath exceeds a maximum threshold, via heat transfer with the cooling fluid; and the cathode and an anode configured to conduct the electricity through the smelting bath, thereby forming the copper coating.

8. The geothermally powered pyrometallurgical copper production system of claim 1, further comprising one or more geothermally powered motors configured to use the heated heat transfer fluid to perform mechanical operations of the geothermally powered pyrometallurgical copper production system, wherein the one or more geothermally powered motors are configured to perform one or more of:

moving the copper sulfide ore through a hopper;

rotating a crusher;

rotating a mixer in the flotation tank;

driving a conveyor to move the copper sulfide through the roaster;

powering air compressors for providing the air to the smelting furnace and/or the converter;

powering exhaust systems to remove gaseous byproducts;

pumping heated heat transfer fluid used to heat vessels and system components; and pumping cooling fluids used to cool system components.

9. The geothermally powered pyrometallurgical copper production system of claim 1, further comprising one or more heat exchangers configured to circulate the heated heat transfer fluid to perform operations of the geothermally powered pyrometallurgical copper production system, wherein the one or more heat exchangers are configured to perform one or more of:

heating the flotation tank;

heating the roaster;

heating the smelting furnace;

heating the converter;

heating the electrolytic smelter;

heating the anode smelter; and heating the foundry.

10. The geothermally powered pyrometallurgical copper production system of claim 1, further comprising one or more air heat exchangers configured to circulate the heated heat transfer fluid, wherein the one or more air heat exchangers are configured to heat one or more air inputs.

11. The geothermally powered pyrometallurgical copper production system of claim 1, further comprising one or more turbines configured to use the heated heat transfer fluid to generate the electricity, wherein the generated electricity provides the electrical current between the cathode and an anode in the electrolytic smelter.

12. The geothermally powered pyrometallurgical copper production system of claim 1, further comprising an absorption chiller configured to:

receive the heat transfer fluid heated by the geothermal system;

generate the cooling fluid using the received heat transfer fluid; and provide the cooling fluid to one or more processes requiring cooling.

13. The geothermally powered pyrometallurgical copper production system of claim 12, further comprising a condenser configured to:

receive the cooling fluid; and condense the heat transfer fluid via heat transfer with the received cooling fluid before the heat transfer fluid is returned to the wellbore of the geothermal system.

14. A method, comprising:

heating, using a geothermal system comprising a wellbore extending from a surface into an underground magma reservoir, a heat transfer fluid via heat transfer with the underground magma reservoir, thereby forming heated heat transfer fluid;

receiving, by a flotation tank, crushed copper sulfide ore and flotation reagents;

suspending the received crushed copper sulfide ore and the received flotation reagents in a slurry held in the flotation tank;

heating the slurry in the flotation tank via heat transfer with the heated heat transfer fluid, thereby forming a froth comprising copper particles;

receiving, by a roaster, at least a portion of the froth produced by the flotation tank;

heating, in the roaster, the received froth via heat transfer with the heated heat transfer fluid, thereby causing the copper particles to be converted to a copper sulfide;

receiving, by a smelting furnace, at least a portion of the copper sulfide produced in the roaster;

receiving, by the smelting furnace, smelting reagents and air;

heating, by the smelting furnace, the received copper sulfide, the received smelting reagents, and the received air at least in part using the heated heat transfer fluid, thereby facilitating reduction of the copper in the copper sulfide and removal of impurities to produce a copper matte and a slag;

receiving, by a converter, at least a portion of the copper matte produced by the smelting furnace;

receiving, by the converter, air;

heating the received copper matte and the received air via heat transfer with the heated heat transfer fluid, thereby facilitating removal of impurities to produce a blister copper;

receiving, by an anode smelter, at least a portion of the blister copper produced by the converter;

transferring heat from the heated heat transfer fluid to the received blister copper, thereby producing a molten blister copper;

receiving, by the anode smelter, a cooling fluid;

transferring heat from the molten blister copper to the cooling fluid, thereby casting a copper anode;

receiving, by an electrolytic smelter, at least a portion of the copper anode produced by the anode smelter;

transferring heat from the heated heat transfer fluid to a smelting bath, thereby maintaining a temperature of the smelting bath within a range associated with electrolytic reduction of copper;

conducting electrical current through the smelting bath using electricity generated using the heated heat transfer fluid, thereby causing a copper coating to form;

receiving, by a foundry, at least a portion of the copper coating produced by the electrolytic smelter;

heating, by the foundry, the received copper coating at least in part using the heated heat transfer fluid, thereby causing the copper coating to melt and become molten copper; and casting, by the foundry, the molten copper to produce a copper product.

15. The method of claim 14, wherein producing the froth comprises:

heating, by one or more heat exchangers coupled to the flotation tank, the slurry via heat transfer with the heated heat transfer fluid;

agitating, by a mixer, the slurry;

injecting, by an air intake, the air into the slurry, thereby facilitating formation of the froth; and directing at least a portion of a byproduct to a waste collection reservoir.

16. The method of claim 14, wherein producing the copper sulfide comprises:

heating, by one or more heat exchangers positioned within or proximate to the roaster, the froth received from the flotation tank via heat transfer with the heated heat transfer fluid; and transporting, by one or more conveyors, the froth through the roaster.

17. The method of claim 14, wherein producing the copper matte comprises:

heating, by one or more heat exchangers positioned within or proximate to the smelting furnace, the smelting furnace via heat transfer with the heated heat transfer fluid, thereby heating the copper sulfide to produce the copper matte and the slag; and heating, by one or more air heat exchangers, an air input via heat transfer with the heated heat transfer fluid, thereby generating heated air.

18. The method of claim 14, wherein producing the blister copper comprises:

heating, by one or more heat exchangers positioned within or proximate to the converter, the converter via heat transfer with the heated heat transfer fluid, thereby heating the copper matte produced by the smelting furnace to facilitate production of the blister copper and the slag;

heating, by one or more air heat exchangers, an air input via heat transfer with the heated heat transfer fluid, thereby heating the copper matte produced by the smelting furnace, thereby producing heated air; and directing, by one or more air compressors positioned within or proximate to the converter, the heated air to the copper matte to cause the copper matte to convert to the blister copper.

19. The method of claim 14, wherein producing the copper anode comprises:

heating, by one or more heat exchangers positioned within or proximate to the anode smelter, the anode smelter via heat transfer with the heated heat transfer fluid, thereby heating the blister copper, thereby transforming the blister copper into the molten blister copper; and cooling, by one or more circulating coolers positioned within or proximate to the anode smelter, the anode smelter via heat transfer with the cooling fluid, thereby cooling the molten blister copper to produce the copper anode.

20. The method of claim 14, wherein producing the copper coating comprises:

if a temperature of the smelting bath is less than a minimum threshold, heating, by one or more heat exchangers positioned within or proximate to the electrolytic smelter, the smelting bath via heat transfer with the heated heat transfer fluid;

if a temperature of the smelting bath exceeds a maximum threshold, cooling, by one or more recirculating coolers positioned within or proximate to the electrolytic smelter, the smelting bath, via heat transfer with the cooling fluid; and conducting the electricity, by a cathode and an anode, through the smelting bath, thereby forming the copper coating.

21. The method of claim 14 further comprising using one or more geothermally powered motors powered by the heated heat transfer fluid, wherein the one or more geothermally powered motors are configured to perform one or more of:

moving the copper sulfide ore through a hopper;

rotating a crusher;

rotating a mixer in the flotation tank;

driving a conveyor to move the copper sulfide through the roaster;

powering air compressors for providing the air to the smelting furnace and/or the converter;

powering exhaust systems to remove gaseous byproducts;

pumping heated heat transfer fluid used to heat vessels and system components; and pumping cooling fluids used to cool system components.

22. The method of claim 14 further comprising causing one or more heat exchangers to use the heated heat transfer fluid to heat a fluid wherein the heated fluid supplies heat for one or more of:

heating the flotation tank;

heating the roaster;

heating the smelting furnace;

heating the converter;

heating the electrolytic smelter;

heating the anode smelter; and heating the foundry.

23. The method of claim 14 further comprising causing one or more air heat exchangers to use the heated heat transfer fluid to heat a fluid wherein the heated fluid supplies heat to one or more air inputs.

24. The method of claim 14, further comprising causing one or more turbines to use the heated heat transfer fluid to generate the electricity, wherein the generated electricity provides the electrical current between a cathode and an anode in the electrolytic smelter.

25. The method of claim 14, further comprising:

receiving, by an absorption chiller, the heat transfer fluid heated by the geothermal system;

generating, by the absorption chiller, the cooling fluid using the received heat transfer fluid; and providing the cooling fluid to one or more processes requiring cooling.

26. The method of claim 25, further comprising:

receiving, by a condenser, the cooling fluid; and condensing, by the condenser, the heat transfer fluid via heat transfer with the received cooling fluid before the heat transfer fluid is returned to the wellbore of the geothermal system.

* * * * *